US009737826B2

(12) United States Patent
Cheng

(10) Patent No.: US 9,737,826 B2
(45) Date of Patent: Aug. 22, 2017

(54) PAIRING BLOCK SET AND TOY BLOCK THEREOF

(71) Applicant: Pai-Chen Cheng, New Taipei (TW)

(72) Inventor: Pai-Chen Cheng, New Taipei (TW)

( * ) Notice: Subject to any disclaimer, the term of this patent is extended or adjusted under 35 U.S.C. 154(b) by 374 days.

(21) Appl. No.: 13/792,127

(22) Filed: Mar. 10, 2013

(65) Prior Publication Data

US 2014/0256211 A1 Sep. 11, 2014

(51) Int. Cl.
*A63H 33/08* (2006.01)

(52) U.S. Cl.
CPC ..... *A63H 33/086* (2013.01)

(58) Field of Classification Search
CPC .... A63H 33/042; A63H 33/086; A63H 33/04; A63H 33/062; A63H 33/08
USPC ..... D21/504
See application file for complete search history.

(56) References Cited

U.S. PATENT DOCUMENTS 2,461,535 A * 2/1949 Erhardt ..... 446/104
2,738,594 A * 3/1956 Swingle ..... A63H 33/04 273/157 R
3,034,254 A 5/1962 Christiansen
3,867,784 A 2/1975 Lange
4,028,844 A * 6/1977 Dideriksen et al. ..... 446/97
4,392,323 A * 7/1983 Rubik ..... A63F 9/08 273/153 S
4,522,404 A * 6/1985 Di Gregorio ..... A63F 9/12 273/157 R
4,602,908 A * 7/1986 Kroeber ..... A63H 33/088 446/124
D285,100 S 8/1986 Volpe
4,740,189 A * 4/1988 Bertrand ..... A63H 33/086 446/102
4,823,532 A 4/1989 Westerburgen
D304,215 S 10/1989 Knudsen
4,964,833 A * 10/1990 Suzuki ..... A63H 33/086 446/118
4,964,834 A 10/1990 Myller
D311,939 S 11/1990 Andersen
D313,437 S 1/1991 Andersen
5,022,885 A * 6/1991 Lyman ..... 446/95
D325,053 S * 3/1992 Skov ..... D21/504
D332,641 S * 1/1993 Skov ..... D21/504
D332,645 S * 1/1993 Knudsen ..... D21/504
D333,853 S 3/1993 Knudsen
(Continued)

*Primary Examiner* — Aarti B Berdichevsky
*Assistant Examiner* — Urszula M Cegielnik
(74) *Attorney, Agent, or Firm* — Alan D. Kamrath; Kamrath IP Lawfirm, P.A.

(57) ABSTRACT

A pairing block set has a right-hand toy block and a left-hand toy block, each of mutual, mirror symmetry and optionally incorporating a system of eight abutment points to each engaged studs on its mating block upon assembling. By providing two different layouts—one for the odd number, and one for the even number tier toy block groups respectively, using a combination of the pairing block set and other commonly seen basic type of blocks for each tier groups, and after stacking up tiers of block groups by different layouts alternatingly, in a tier-to-tier mutual interlocking manner, a structurally sound assembly of an oblique sided structure can be built with smoothly lined sides or walls. A plurality of latches is left at both ends of the assembly, to be further interlocked with its neighboring, mating toy blocks of the intended final structure.

2 Claims, 36 Drawing Sheets

(56) References Cited

U.S. PATENT DOCUMENTS

| | | | | | |
|---|---|---|---|---|---|
| D335,162 | S | | 4/1993 | Knudsen | |
| D344,300 | S | * | 2/1994 | Knudsen | D21/504 |
| 5,304,086 | A | | 4/1994 | Bolli et al. | |
| D350,165 | S | * | 8/1994 | Refsing | D21/504 |
| D350,791 | S | | 9/1994 | Refsing | |
| 5,344,143 | A | * | 9/1994 | Yule | 273/118 R |
| 5,411,428 | A | * | 5/1995 | Orii et al. | 446/90 |
| 5,782,667 | A | * | 7/1998 | Luby | 446/69 |
| 5,827,106 | A | * | 10/1998 | Crepeau et al. | 446/128 |
| 5,830,032 | A | * | 11/1998 | Campbell | 446/128 |
| 5,853,314 | A | * | 12/1998 | Bora | A63H 33/086 446/102 |
| 5,944,575 | A | * | 8/1999 | Tolnay | 446/168 |
| 6,050,873 | A | | 4/2000 | Reisman | |
| 6,126,506 | A | * | 10/2000 | Rudy | 446/85 |
| 6,186,856 | B1 | * | 2/2001 | Chen | A63H 33/04 446/117 |
| 6,200,187 | B1 | * | 3/2001 | Olsen et al. | 446/122 |
| 6,283,818 | B1 | * | 9/2001 | Kushner et al. | 446/476 |
| 6,340,323 | B1 | * | 1/2002 | Glynn | 446/89 |
| 6,554,675 | B1 | * | 4/2003 | Nyengaard | 446/85 |
| 6,659,463 | B2 | * | 12/2003 | Mackey | 273/276 |
| D522,067 | S | * | 5/2006 | Allen | D21/321 |
| 7,063,587 | B1 | * | 6/2006 | Lin | A63H 33/086 273/156 |
| 7,229,334 | B2 | * | 6/2007 | Ishikawa | 446/91 |
| 8,905,812 | B2 | * | 12/2014 | Pai-Chen | 446/122 |
| 9,517,423 | B1 | * | 12/2016 | Kanbar | A63H 33/042 |
| 9,539,519 | B2 | * | 1/2017 | Vollers | B65D 81/361 |
| D786,985 | S | * | 5/2017 | Ramiere | D21/505 |
| 2006/0264147 | A1 | * | 11/2006 | Shoptaugh | 446/120 |
| 2008/0274665 | A1 | * | 11/2008 | Cheng | 446/118 |

* cited by examiner

PAIRING BLOCK SET AND TOY BLOCK THEREOF

BACKGROUND OF THE INVENTION

Field of the Invention

The invention relates to a toy block set, particularly, to a pairing toy block set of mutual, mirror symmetry, each having an oblique-plane at one end, and, more particularly, to a toy block assembly having at least one side being of an oblique plane and composed of tiers of toy block groups of different, alternating layouts for tier-to-tier interlocking, with each tier comprising a combination of at least one toy block.

Description of Prior Art

FIG. 1A is an isometric, lower view showing a prior-art "Basic" type, toy block 10 consisting of eight studs as an example. FIG. 1B is an isometric, upper view of the same. Referring to FIGS. 1A and 1B, the prior-art toy block 10 has:

a box-shaped 11 a number of studs 12 placed on a top surface of the box-shaped body 11.

an open space 13 at a bottom of the box-shaped body 11;

a plurality of bottom posts 14, plus a plurality of edge stoppers 15 in the open space 13.

The system with such prior-art toy blocks 10 is basically intended for mutual interlocking and assembling with its mating toy blocks using various assembling combinations, while having only three abutting points per each engaged studs 12 upon assembling.

FIG. 1C is a schematic, top view showing a configuration (or layout) 10A for one of the tiers among several other tiers that together, after being stacking up, is intended for making a V-shaped structure model. This tier group is comprised of a number of the prior-art toy-blocks 10. The attempt is to stack up a number of such tiers, in order to simulate a V-shaped structure, like a canted bay window for example, as viewed from the top.

The resulting overall contour of the structure, after stacking up tiers consisting of the prior-art toy blocks 10 only, is far from its intended neat, smoothly lined, bay window, because all the four sidewalls of the prior-art toy block 10 are vertical to each other, thereby rendering the oblique sides of the bay window in jagged lines (or planes), instead of neat, smooth lines (or planes) required of a bay window. One of the solutions with the prior-art system over such challenges is to make a new block in one integral piece, complete with the overall oblique sides and shapes of the final assembly, instead of using a combination of construction elements for multiple assembling in forming the intended oblique (or oriel) sides, consequently leaving little choice for assembling combinations. Such prior-art solutions are as-cast rigid, loosing the basic workings of construction toys in terms of multiple assembling, flexibility, creativity, and combination choices.

SUMMARY OF THE INVENTION

The primary object of the invention is to provide a pair of wedged toy blocks (30 of FIG. 3A, and 30' of FIG. 5A) that will interlock with each other under multiple arrangements of assembling, while leaving a plurality of latches (L1 and L2 of FIG. 7C) at both ends after stacking up, to further interlock with the mating toy blocks at the neighboring wall of the structure. The idea is to alternately stack tiers of toy block groups in two different layouts (such as 40A of FIG. 7A and 40B of FIG. 7B). One layout is for the odd number tiers, while the other is for the even number tiers. Each layout consists of a combination of the pair of wedged toy blocks (30 and 30'), together with some of the basic type blocks (20 of FIG. 4A) that this invention may provide, or, optionally, together with those similar to the commonly seen prior-art toy block (10 of FIG. 1B) instead, on each of the stacking tiers. After stacking up (or assembling), the final assembly will result in interlocked, structurally sound, neat, smooth lines (or plane, shape) on the oblique sides of such a V shaped structure (FIG. 7C), which is intended to simulate a bay window for an example, while at the same time after stacking up, leaving a plurality of latches for further interlocking with the mating toy blocks of the neighboring walls, towards the final completion of a building containing the bay window.

The primary object of the invention is to provide a pairing toy block set, consisted of a pair of wedged toy blocks (30 of FIG. 3A, and 30' of FIG. 5A) in mutual mirrored symmetry, with each having a plurality of sidewalls, with one of the sidewalls (31A of FIG. 3A) connecting to its neighboring sidewalls obliquely, thereby enabling a combination of the present invention—the pair of wedged toy blocks (30 and 30'), together with some of the basic type blocks (20 of FIG. 4A), to form two different layouts (40A of FIG. 7A, and 40B of FIG. 7B) for the stacking tiers. By alternatingly stacking up the tiers of the two different layouts for interlocking, the assembly (FIG. 7C), simulating a bay window, will result in neat smooth planes on its oblique sides after stacking up, with an interlocked overall integrity, plus leaving a plurality of latches at both ends of the assembly for further interlocking with its neighboring, mating blocks of the intended structure to continue towards final completion of a building.

To achieve the objective aforementioned, the present invention provides a pair of wedged toy blocks (30 of FIG. 3A, and 30' of FIG. 5A), in mutual, mirror symmetry to each other. The pair of wedged toy blocks is made of a plastic material, designed to be assembled and interlocked with the mating toy blocks of the same, or of other compatible engagement systems commonly seen on the market.

While not precluding the utilization of adopting a similar, compatible engagement system with that of the prior-art block 10 (which has only three abutting points per each engaged stud) for the engagement system with the pair of wedged toy blocks (30 and 30') of the present invention, as an option, this invention further offers an improved engagement system that provides eight abutting points per each engaged stud, to further enhance the grabbing capability with each engaged stud.

Taking for example, the wedged toy block 30 as one of the pairing blocks incorporating the eight-abutment system comprises:

a plurality of sidewalls (31A through 31D of FIG. 3A), a plurality of studs 22, a plurality of recessed portions (23 of FIG. 3B), at least one bottom post 24, at least one semi-circle post 24A, a plurality of edge stoppers 27, two corner stoppers 26 (one on the two right-angled corners), and a plurality of rib pairs 25.

At least one of the sidewalls 31A connects to its neighboring sidewalls 31B and 31D) obliquely.

The studs 22 of FIG. 3A and the recessed portions 23 of FIG. 3B are disposed at the top side (shown in FIG. 3A) and the bottom side (shown in FIG. 3B) of the wedged toy block 30, respectively.

The bottom posts 24 of FIG. 3B are disposed at the bottom side of the toy block, surrounded by the recessed portions 23.

The semi-circle posts 24A of FIG. 3B are disposed at the bottom side of the toy block, and protrude from the inner of the sidewalls of the wedged toy blocks.

The rib pairs 25 of FIG. 3B are connected between two of the bottom posts, or between the bottom posts and the semi-circle posts. Each of the rib pairs 25 has arched protrusions from its two sides thereof towards the recessed portions.

When one of the studs 22 of the toy block is inserted (or engaged) into one of the recessed portions 23 of a mating toy block, the engaged studs will have its cylindrical sidewall abutting against the protrusions around the one of the recessed portions of a mating toy block, such that the one of the engaged studs of the toy block is fixed with the one of the recessed portions of the mating toy block by eight abutment points.

In one embodiment of the present invention, not restricting to the exact components making up the eight-abutment system, the number of the sidewalls is four. A sharp angle is formed between the oblique sidewall (31A of FIG. 3B) and its longer neighboring sidewall 31B This is a result of cutting one corner off of a box-shaped block, such as that of the prior-art toy block 10. In one embodiment of the present invention, not restricting to the exact components making up the eight-abutment system, the sharp angle ($\alpha$ of FIG. 3A) can be from 45° as shown when cutting off a corner of basic type block (20 of 40A) by two "stud pitches" and through 63.5° (hereby called 60° type wedged block 80 of FIG. 13A) when cutting off a corner by only one stud pitch. (Note: one stud pitch is the distance between the center lines of two neighboring studs.)

Taking a block consisting of a 60° type wedged block as an example variation of this invention, not restricting to the exact components making up the eight-abutment system, use of such block can achieve a hexagonal walled structure (as compared to an octagonal wall structure that can be formed by incorporating a 45° wedged block pair, per that partially shown on a top view of FIG. 8A), or a hex bow window (as compared to a canted bay window that can be formed by incorporating a 45° wedged block pair, per FIG. 7C).

In one embodiment of the present invention, the sidewalls (per FIG. 3A) include:

a oblique sidewall 31A,
a longer sidewall 31B,
a opposite sidewall 31C, and
a shorter sidewall 31D.

The oblique sidewall 31A (the oblique one) connects the longer sidewall 31B and the shorter sidewall 31D obliquely. The longer sidewall 31B is mutually in parallel with the shorter sidewall 31D, with both connecting to the opposite sidewall 31C vertically (that is by a right angle, 90°) respectively.

Hence, the angle between the oblique sidewall 31A and the shorter sidewall 31D is an obtuse angle (180° minus that of the sharp angle $\alpha$ of FIG. 3A).

It is important to note that the bottom edge of the oblique sidewall 31A must not cross over to any one studs of its mating toy blocks during assembling, because such will cause interference. Particularly, the oblique sidewall bottom will need to sit in the space inbetween the studs of its mating toy blocks. Having said so however, another variation block (41 of FIG. 5C) is provided with notches (32 of FIG. 5C), to allow the oblique sidewall bottom to cross over the studs of a mating block, although resulting in inferior aesthetics on the oblique sidewall.

In addition, as an option, a through-hole (22A of FIG. 4A) is provided on each of the studs on the pair of wedged toy blocks of this invention, so that an optional securing device of separate design can serve to positively lock the assembled blocks by the through-hole, or can serve as a hinge when only one of the studs at the corners is engaged in an assembly.

Also as an option, one or more of the studs may be provided with toothed serrations (T of FIG. 6D) on its top, serving as a ratchet for positioning (or for angular direction) when an optional mating device of a different design such as an angle connector (C of FIG. 6D) is attached to the stud by a screw (S of FIG. 6D) coming from the recess portion on the bottom, sticking out of the hole on the stud. The serrations may also serve as a tooth lock washer when a nut is being attached to the stud.

To explain the application and the combination use of the present invention, with one of the blocks consisting of a combination of blocks on each of the aforementioned tiers, an example basic type block (20 of FIGS. 4A and 4B) is also presented herein for demonstration purposes, which is of a similar eight-abutment engagement system with the pair of wedged toy blocks (30 and 30').

Another variation of this invention, but not restricting to the exact components making up the eight-abutment system, is a shorten version of the Wedged Block Pair 30 and 30', which is half the length of the pair of wedged toy blocks, consisting only three studs. (See 80A of FIG. 13B). It is shortened for the purpose of reducing the overall size of an assembled structure, as being used in combination with another shortened version of the basic toy block, which is half the length of the example basic toy block 20, consisting of only four studs.

The foregoing, as well as additional objects, features and advantages of the invention will be more readily apparent from the following detailed description, which proceeds with reference to the accompanying drawings.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

FIG. 6A shows an assembly simulating a robotic arm.

FIG. 6B shows that the pair of wedged toy blocks 30 and 30' can form a V frame holder for supporting a rod or a tube 28, onto which a load can be hung.

FIG. 6C shows the lower left side of a truss, with one of the pair of wedged toy blocks (30 and 30') serving as a footing for an inclined beam making a part of a truss.

DESCRIPTION OF EMBODIMENTS

Other features and advantages of the invention will be further understood from the further technological features disclosed by the embodiments of the invention shown and by the described embodiments of this invention, simply by way of illustration of best modes to carry out the invention.

Figure 2:
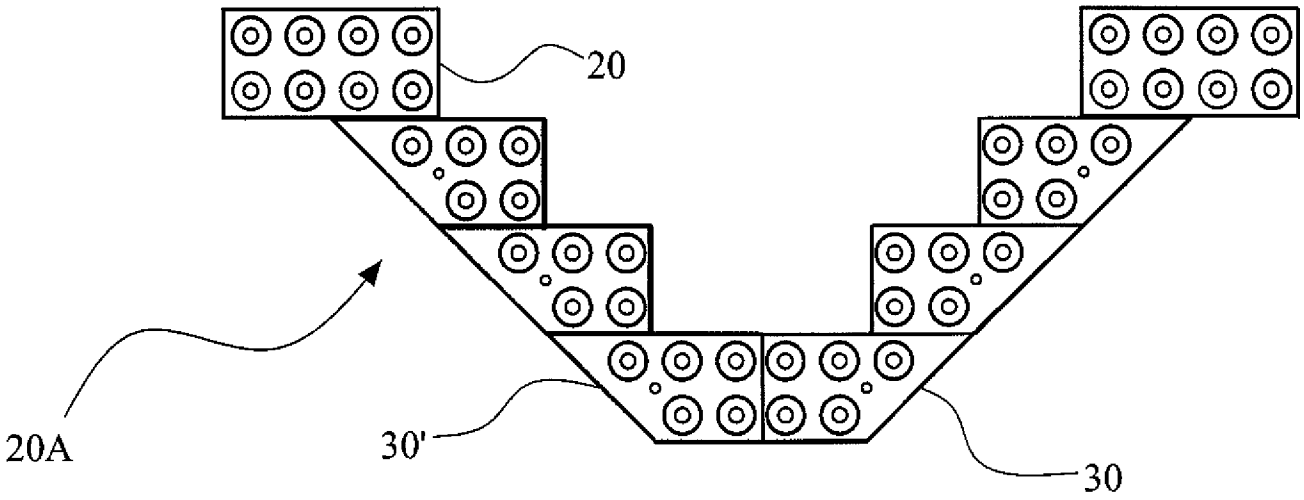
FIG. 2 is a schematic top view showing an improved layout for one of the tiers for stacking up a V-shaped structure.

In accordance with one embodiment of the present invention, FIG. 2 is a schematic top view showing a layout 20A comprising the odd number tiers for stacking up to a pairing block set of a V-shaped structure that simulates a canted bay window for example, as viewed from the top. The odd number tier toy block group of the layout 20A comprises at least a right-hand wedged toy block 30, at least a basic type block 20 and at least a left-hand wedged toy block 30'.

Figure 3A:
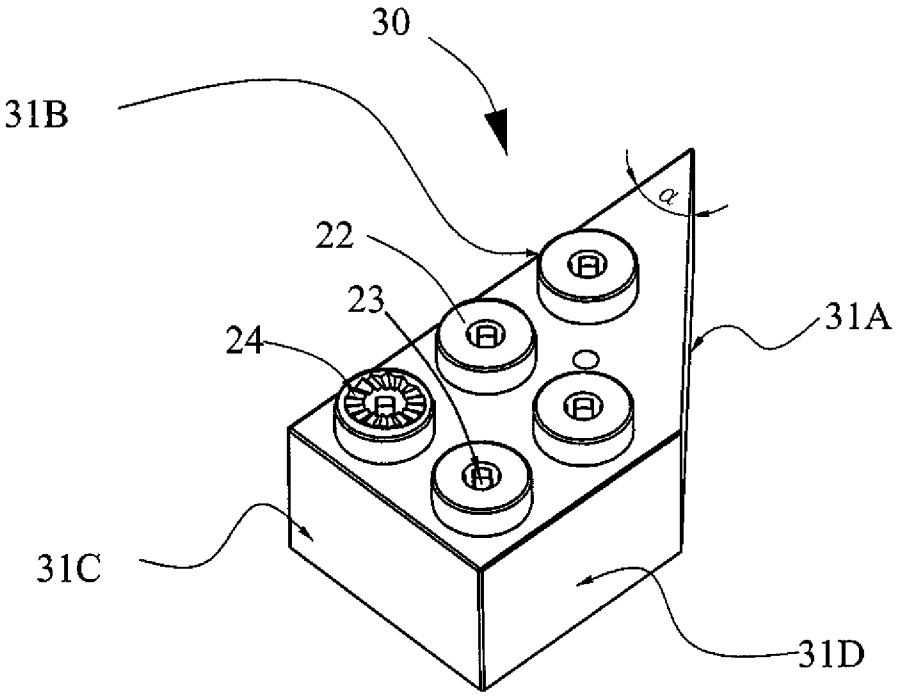
FIG. 3A is an isometric upper view of the right-hand wedged toy block 30 used in FIG. 2.
Figure 3B:
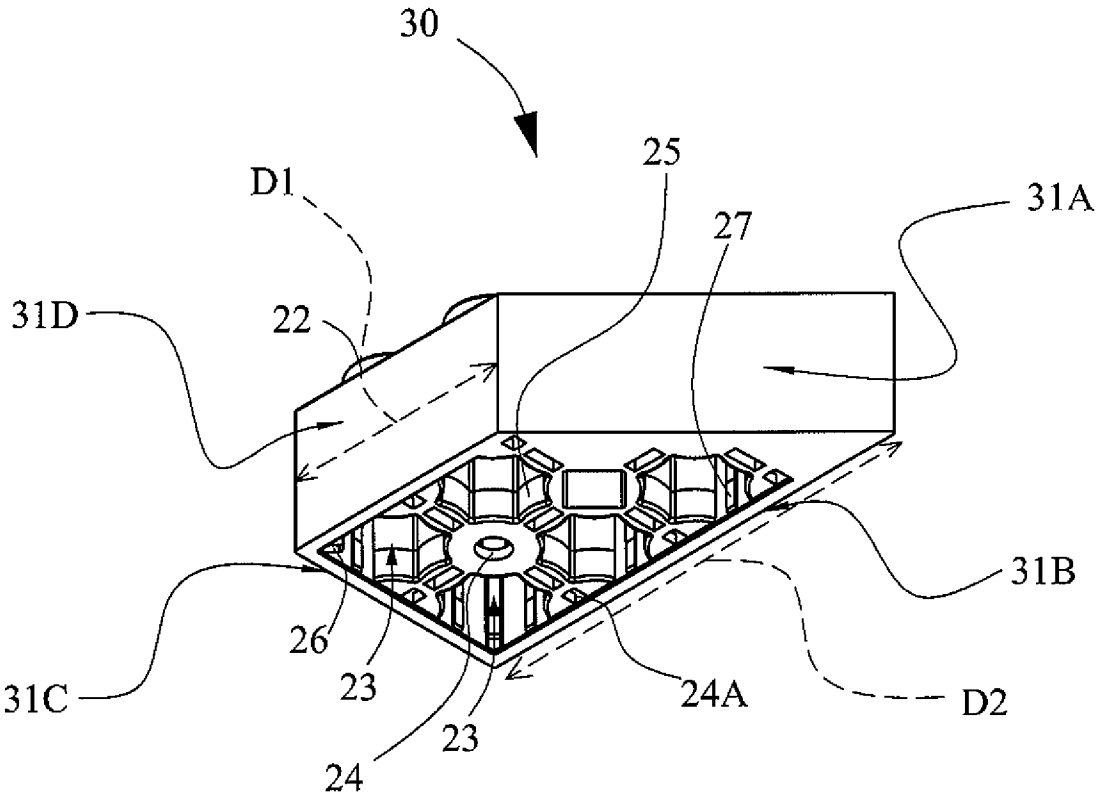
FIG. 3B is an isometric lower view of the same toy block 30.
Figure 4A:
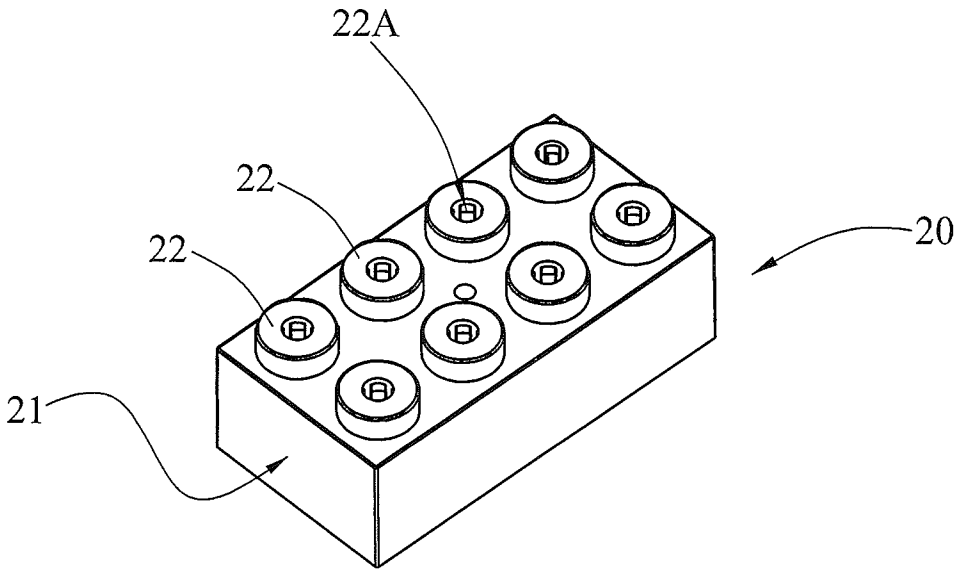
FIG. 4A is an isometric upper view of the basic type toy block 20 used in FIG. 2.
Figure 4B:
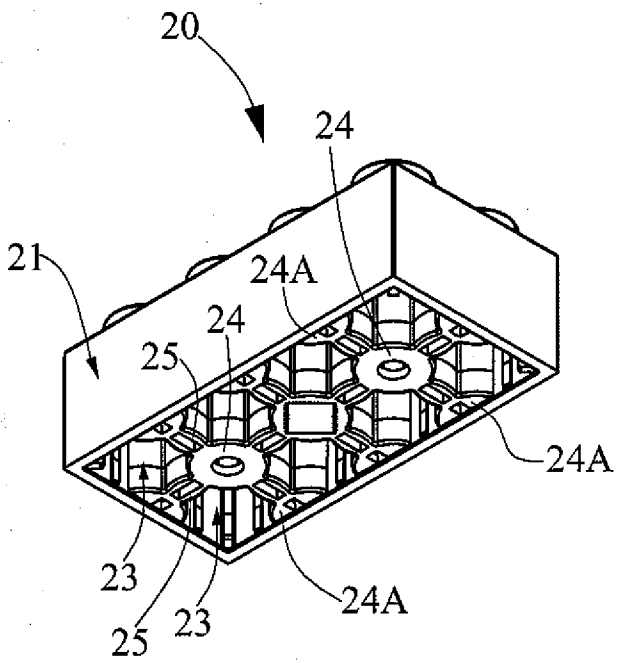
FIG. 4B is an isometric lower view of the same block 20.
Figure 5A:
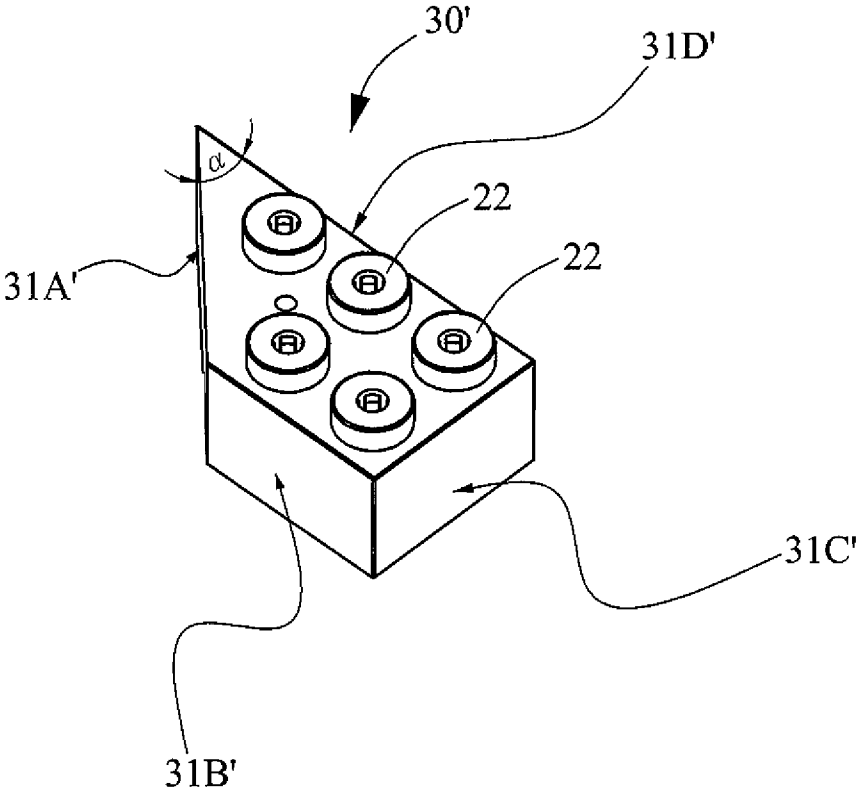
FIG. 5A is an isometric upper view of the left-hand wedged toy block 30' used in FIG. 2.
Figure 5B:
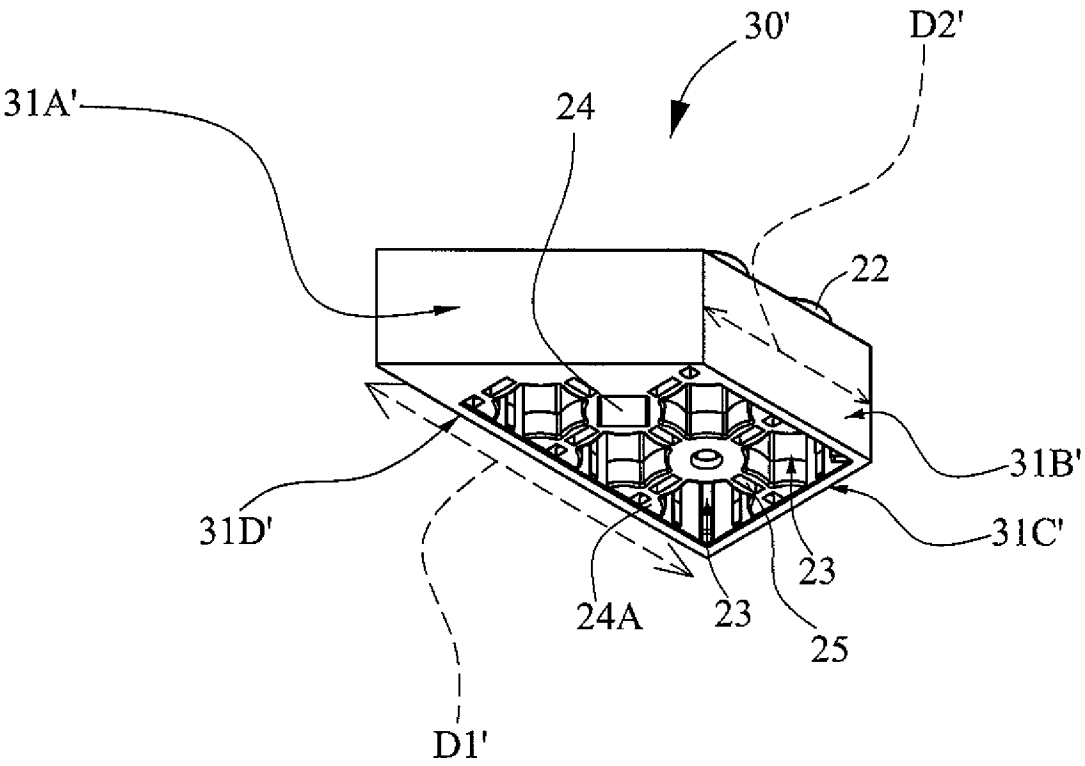
FIG. 5B is an isometric lower view of the same block 30'.

FIG. 3A is an isometric upper view showing a right-hand wedged toy block 30 as used in FIG. 2. FIG. 3B is an isometric lower view of the same. FIG. 4A is an isometric upper view showing a basic type block 20 as used in FIG. 2. FIG. 4B is an isometric lower view of the same. FIG. 5A is an isometric upper view showing a left-hand wedged toy block 30' as used in FIG. 2. FIG. 5B is an isometric lower view of the same.

Referring to FIGS. 3A, 3B, 4A, 4B, 5A, and 5B, in the present embodiment, the right-hand wedged toy block 30, the basic type block 20 and the left-hand wedged toy block 30' are, for example, made of a plastic material, but not restricted to the exact components making up an eight-abutment system. The Block right-hand wedged toy block 30, the basic type block 20, and the left-hand wedged toy block 30' are each comprised of four sidewalls, respectively. In the present embodiment, the right-hand wedged toy block 30 for example, has:

an oblique sidewall 31A,
a longer sidewall 31B,
an opposite sidewall 31C, and
a shorter sidewall 31D.

The oblique sidewall 31A and the opposite sidewall 31C are located at two sides of the longer sidewall 31B and the shorter sidewall 31D, respectively. Worth mentioning is that the oblique sidewall 31A connects to the longer sidewall 31B and the shorter sidewall 31D obliquely in the present embodiment. In another words, the length D1 of the shorter sidewall 31D is less than the length D2 of the longer sidewall 31B The opposite sidewall 31C connects with the longer sidewall 31B and the shorter sidewall 31D vertically. Hence, a sharp angle $\alpha$ is defined between the oblique sidewall 31A and the longer sidewall 31B of the right-hand wedged toy block 30. The sharp angle $\alpha$ ranges, for example, from 45° to 63.5°. In contrast, the angle between the oblique sidewall 31A and the shorter sidewall 31D is an obtuse angle. In the present embodiment, the shape of the right-hand wedged toy block 30 is, for example, shaped like a trapezoid.

Referring to FIG. 4A, the basic type block 20 has four sidewalls 21, and the sidewalls 21 of the basic type block 20 connect with each other vertically. The shape of the basic type block 20 is, therefore, shaped like a rectangle brick.

Referring to FIG. 5A, the left-hand wedged toy block 30' is a symmetrical, mirror imaged counterpart of the right-hand wedged toy block 30. Similar to its pairing counterpart, the left-hand wedged toy block 30' also has the oblique sidewall 31A', the shorter sidewall 31B', the opposite sidewall 31C', and the longer sidewall 31D'. The oblique sidewall 31A' and the opposite sidewall 31C' are located at two sides of the shorter sidewall 31B' and the longer sidewall 31D', respectively. The length D1' of the longer sidewall 31D' is larger than the length D2' of the shorter sidewall 31B'. Like the right-hand wedged toy block 30, the oblique sidewall 31A' connects with both the shorter sidewall 31B' and the longer sidewall 31D' obliquely. The oblique direction with the oblique sidewall 31A' is the exact mirror image of the oblique direction of its counter part—i.e. the oblique sidewall 31A of the right-hand wedged toy block 30.

The opposite sidewall 31C' connects with the longer sidewall 31D' and the shorter sidewall 31B' vertically. Relatively, the angle between the oblique sidewall 31A' and the longer sidewall 31D' is, for example, the sharp angle $\alpha$. The sharp angle may range from 45° to 63.5°. The angle between the oblique sidewall 31A' and the shorter sidewall 31B' is an obtuse angle. Similarly, the shape of the left-hand wedged toy block 30' is, for example, shaped like a trapezoid.

Therefore, through the above different layout for different stacking tiers, and the design of the right-hand wedged toy block 30 and the left-hand wedged toy block 30', the layout 20A for the odd number tiers will constitute part of the V shape structure simulating a bay window to result in smooth lines (or planes) at its oblique sides.

Figure 1A:
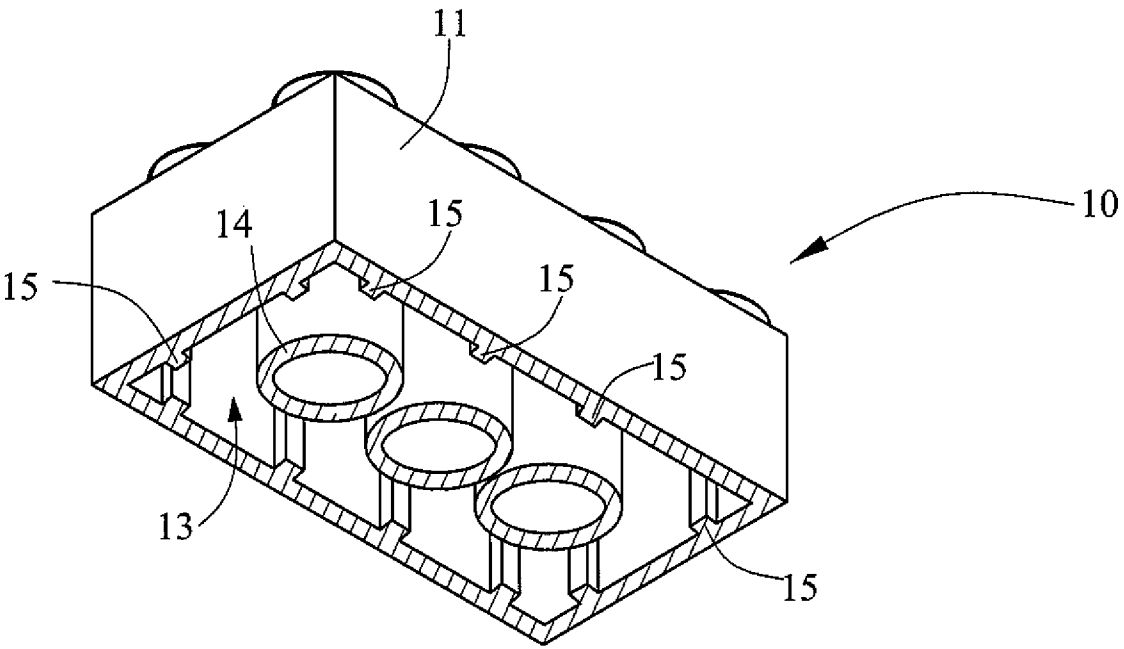
FIG. 1A(PRIOR ART)
FIG. 1A is an isometric upper view showing a prior-art, "Basic" type, toy block.
Figure 1B:
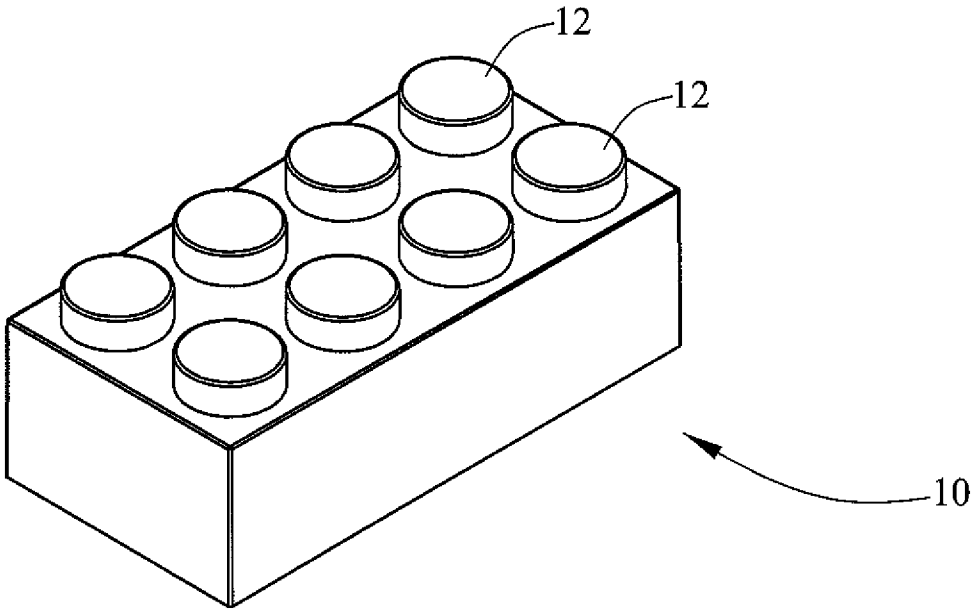
FIG. 1B(PRIOR ART)
FIG. 1B is an isometric lower view of the same toy block in FIG. 1A.
Figure 1C:
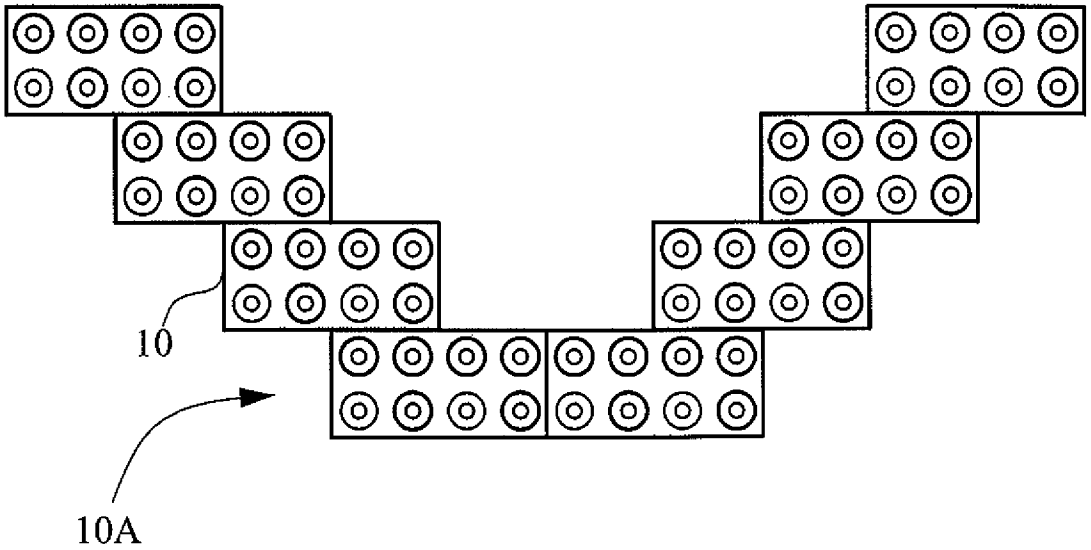
FIG. 1C(PRIOR ART)
FIG. 1C is a schematic top view showing a layout 10A for one of the tiers for stacking up an assembly, using a number of the prior-art, "Basic" type, toy blocks 10 only, in an attempt to form a V-shaped structure, such as a bay window for example—which attempt only results in jagged lines (or planes) on the oblique (or the oriel) sides of the bay window.

While not precluding the adoption, for purpose of simplification, of the engagement system that only has three abutment points to each engaged studs, such as that of the prior-art basic type block 10 of FIG. 1A, the right-hand wedged toy block 30, the basic type block 20 and the left-hand wedged toy block 30' all can be provided with a system of eight abutment points to each engaged studs under the present invention, which is thus illustrated in detail.

In the present embodiment, the right-hand wedged toy block 30, the basic type block 20 and the left-hand wedged toy block 30' have a plurality of stud 22 at a top surface hereof, where the studs 22 are arranged in an array. The right-hand wedged toy block 30, the basic type block 20 and the left-hand wedged toy block 30' each have at their bottom sides:

a plurality of recessed portions 23,
a plurality of bottom posts 24,
a plurality of semi-circle posts 24A,
a plurality of corner stoppers 26,
a plurality of edge stoppers 27, and
a plurality of rib pairs 25, thereof.

The recessed portions 23 and the studs 22 are at common axes. That is, the recessed portions 23 are vertically under the studs 22. The recessed portions 23 are surrounded by the sidewalls, and the bottom posts 24 are surround by a plurality of recessed portions 23. The bottom posts 24 are like hollow tubes with an interior hole.

Each semi-circle post 24A protrudes from the corresponding sidewall of the toy block, and is shaped like hollow semi-circular pillar with another interior hole.

In addition, the rib pairs 25 are connected between two of the bottom posts 24, or between the bottom posts 24 and the semi-circle posts 24A. Each of the rib pairs 25 has protrusions from two sides thereof to the corresponding recessed portions 23.

In addition, a corner stopper 26 is provided at each of the two inner right angle corners of the sidewalls (that is, excluding the sharp angle $\alpha$ and its corresponding obtuse corner).

Also, an edge stopper 27 is provided inside of the sidewall, at the center of the distance inbetween the neighboring semi-circle posts, or inbetween each inner right angle corner and its neighboring semi-circle posts.

From the above, the studs 22 of each toy block correspondingly match the recessed portions 23 of another toy block. Therefore, each of an engaged studs 22 of the toy block will abut against the corresponding recessed portions 23 by eight abutting points when the studs 22 of the toy block are inserted into the recessed portions 23 of a mating toy block.

Figure 5C:
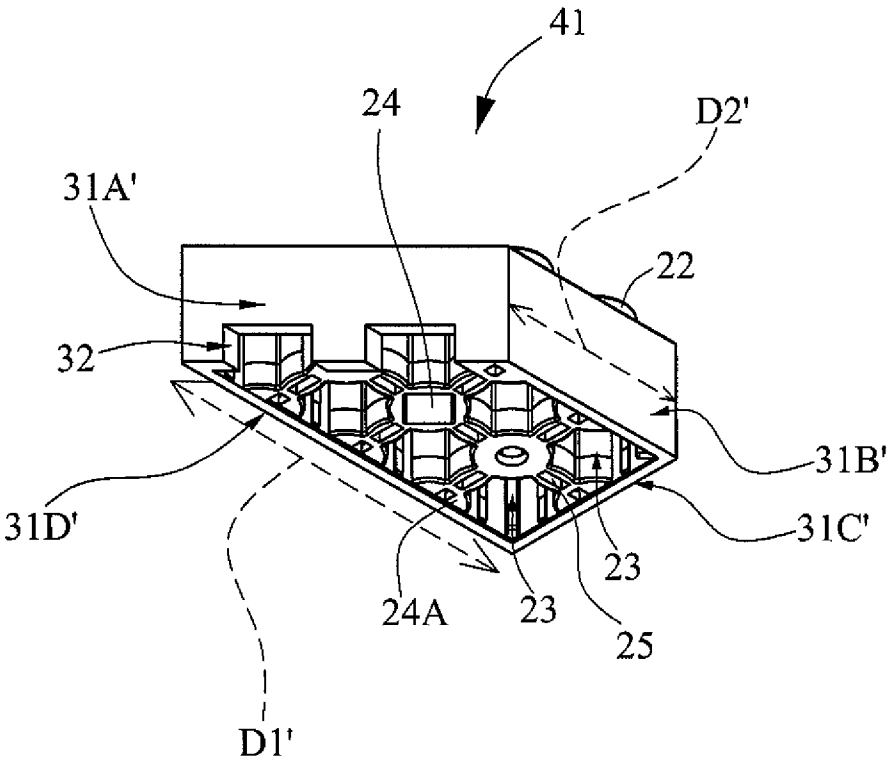
FIG. 5C is an isometric view of a variation wedged toy block 41, with notches 32 at the bottom of the oblique sidewall.

FIG. 5C is a variation wedged toy block 41 of similar shape with that of left-hand wedged toy block (30' of FIG. 5A), except that it has a plurality of rectangular shaped notches 32 at the bottom of the oblique sidewall 31A'. The width of the notch is equal to the diameter of the stud 22, and the height of the notch is equal to the height of the stud. The centerline of the notches corresponds to the location of the stud centerlines in an array. This is intended to allow the oblique sidewall bottom to cross over the studs on a mating block, although with inferior aesthetics on the oblique sidewall with the notch openings.

Figure 6A:
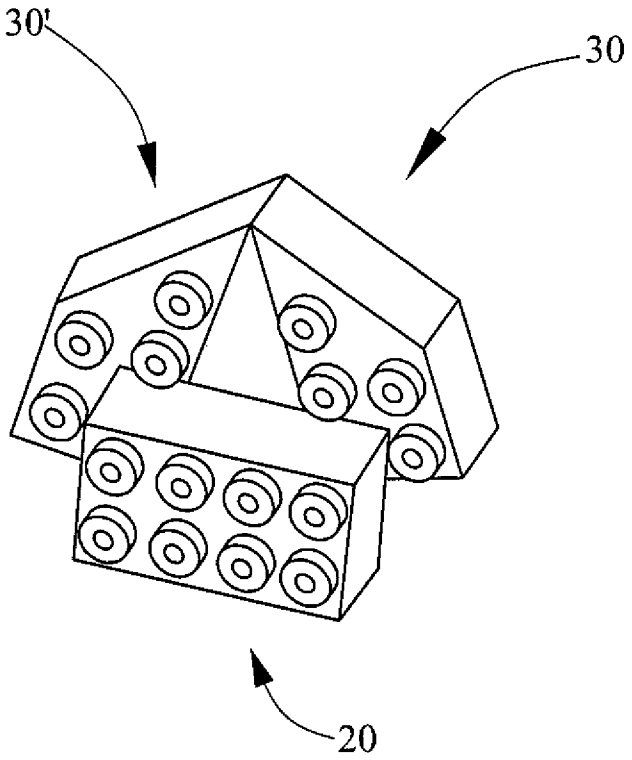
FIGS. 6A through 6C are isometric views showing examples of different applications and variations of assemblies using a combination of the pair of wedged toy blocks 30 and 30' together with the basic type block 20.
Figure 6B:
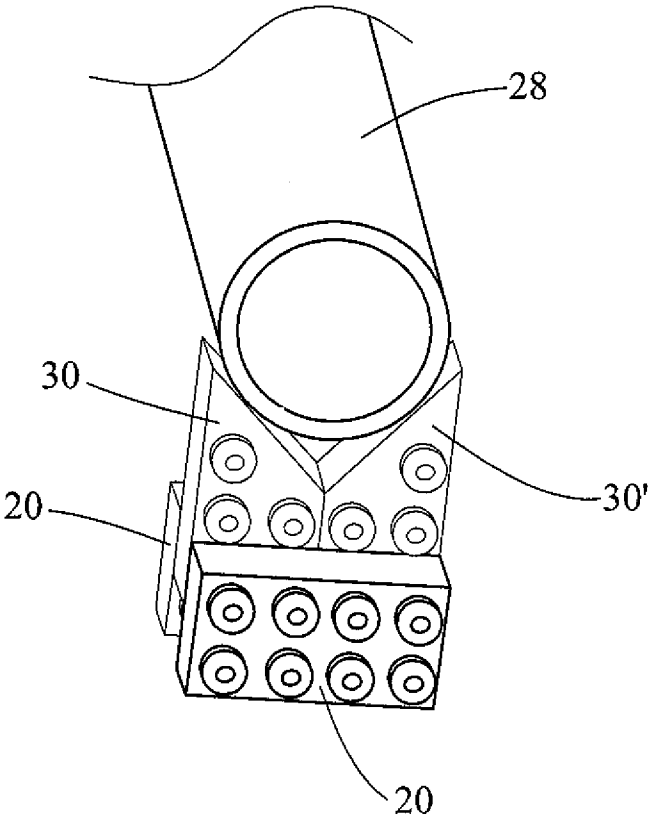
Figure 6C:
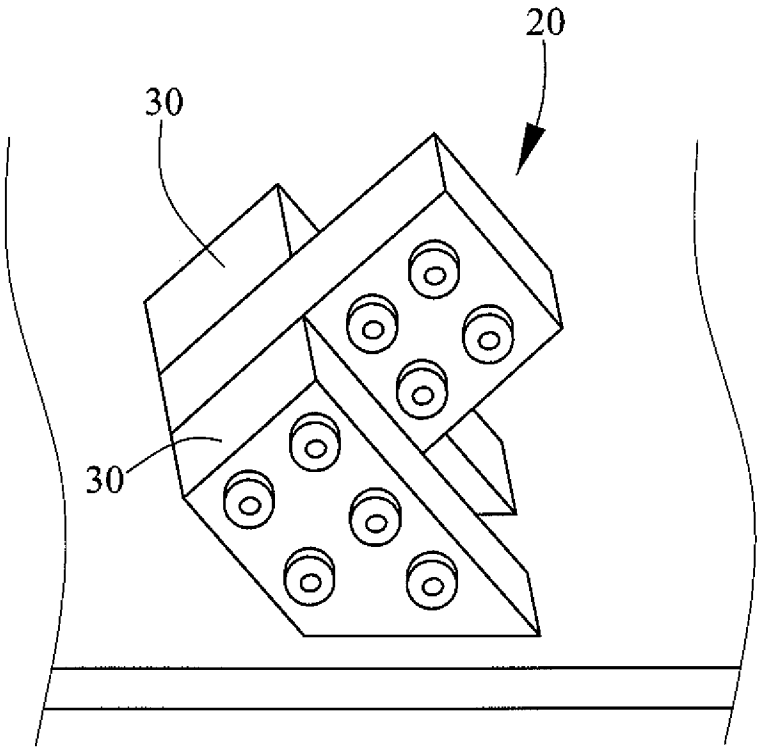

FIGS. 6A through 6C are schematic views showing variations of the assemblies and applications in combination use of the right-hand wedged toy block 30, the basic type block 20, and the left-hand wedged toy block 30'.

For example, in FIG. 6A, the right-hand wedged toy block 30, the basic type block 20, and the left-hand wedged toy block 30' are assembled in an assembly shaped like a small robotic arm, with both the wedged blocks so hinged on one studs at one of the corners, enabling them to move.

In FIG. 6B, the right-hand wedged toy block 30, the basic type block 20, and left-hand wedged toy block 30' are assembled like a supporting frame for supporting a long circular pipe 28, so that a user can hang a load on the long circular pipe 28.

In FIG. 6C, the right-hand wedged toy block 30 serves as a support for footing a basic type block 20 simulating a portion of an inclined beam as part of a truss, for example.

Figure 6D:
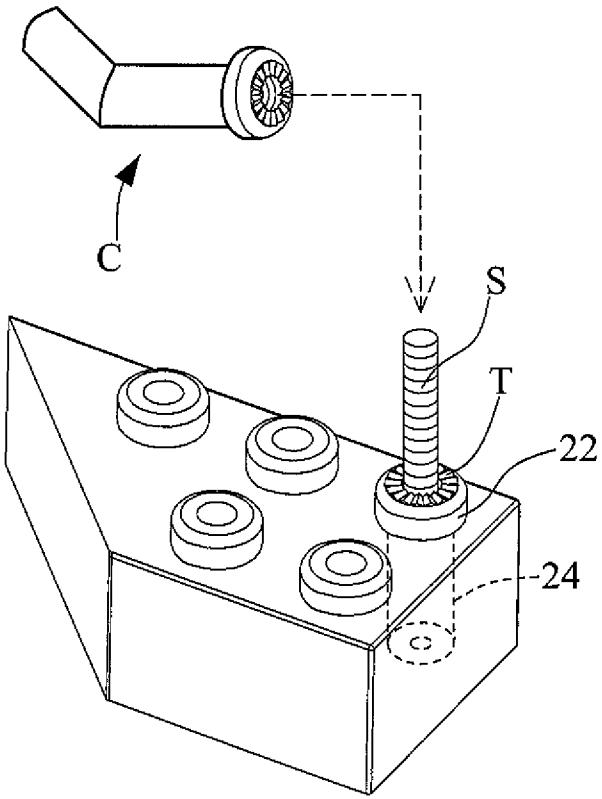
FIG. 6D is an isometric view showing one representative wedged toy block featuring serrations T at one of its corner studs, enabling the locking of the angular direction with an optional mating device C.

In FIG. 6D, also as an option, one or more of the studs may be provided with toothed serrations T on its top, serving as a ratchet for positioning (or for angular direction), when an optional mating device C of a different design, such as an angle connector, is attached to the stud by a screw S coming from the recess portion on the bottom, and sticking out of the hole on the stud. The serrations may also serve as a tooth lock washer when a nut is being attached to the stud.

Figure 7A:
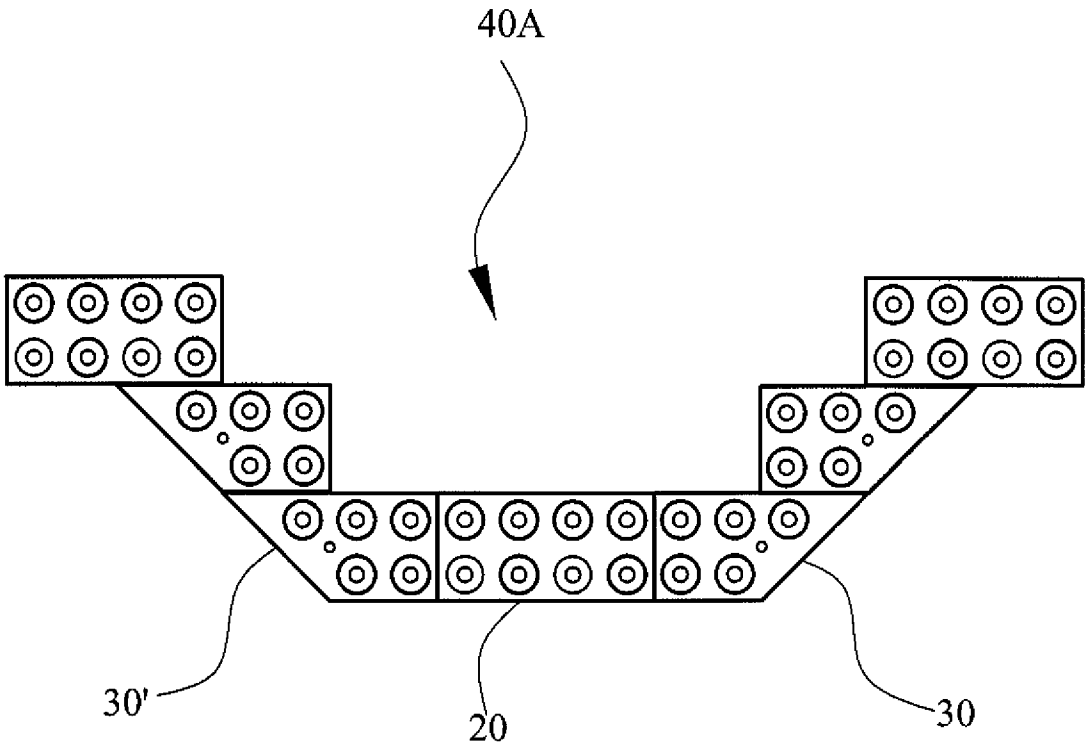
FIG. 7A is a schematic top view showing the first layout 40A for the odd number tier block groups in stacking up to a V-shaped assembly structure simulating a bay window, by using a combination of the pair of wedged toy blocks and the basic type block 20.

FIG. 7A is a schematic top view showing the first layout 40A for the odd number tier toy block groups needed to make a flatter version of a V-shaped assembly structure (as compared to that of FIG. 2), simulating a bay window, which is also a combination using the right-hand wedged toy block, the basic type block, and the left-hand wedged toy block.

Figure 7B:
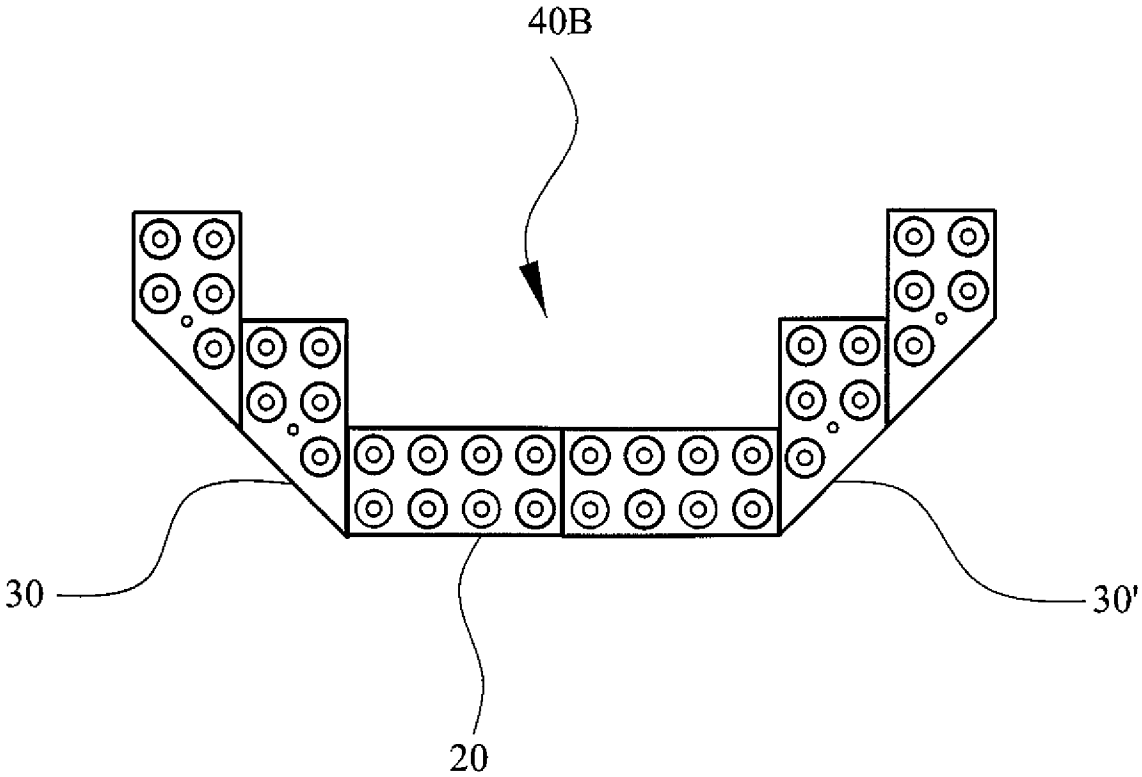
FIG. 7B is a schematic top view showing the alternating, second layout 40B for the even number tier block groups in stacking up to a V-shaped assembly structure.

FIG. 7B is a schematic top view showing the alternating, second layout 40B for the even number tier toy block groups to complement the layout of the odd number tier (40A of FIG. 7A), to complete assembling of the bay window.

Figure 7C:
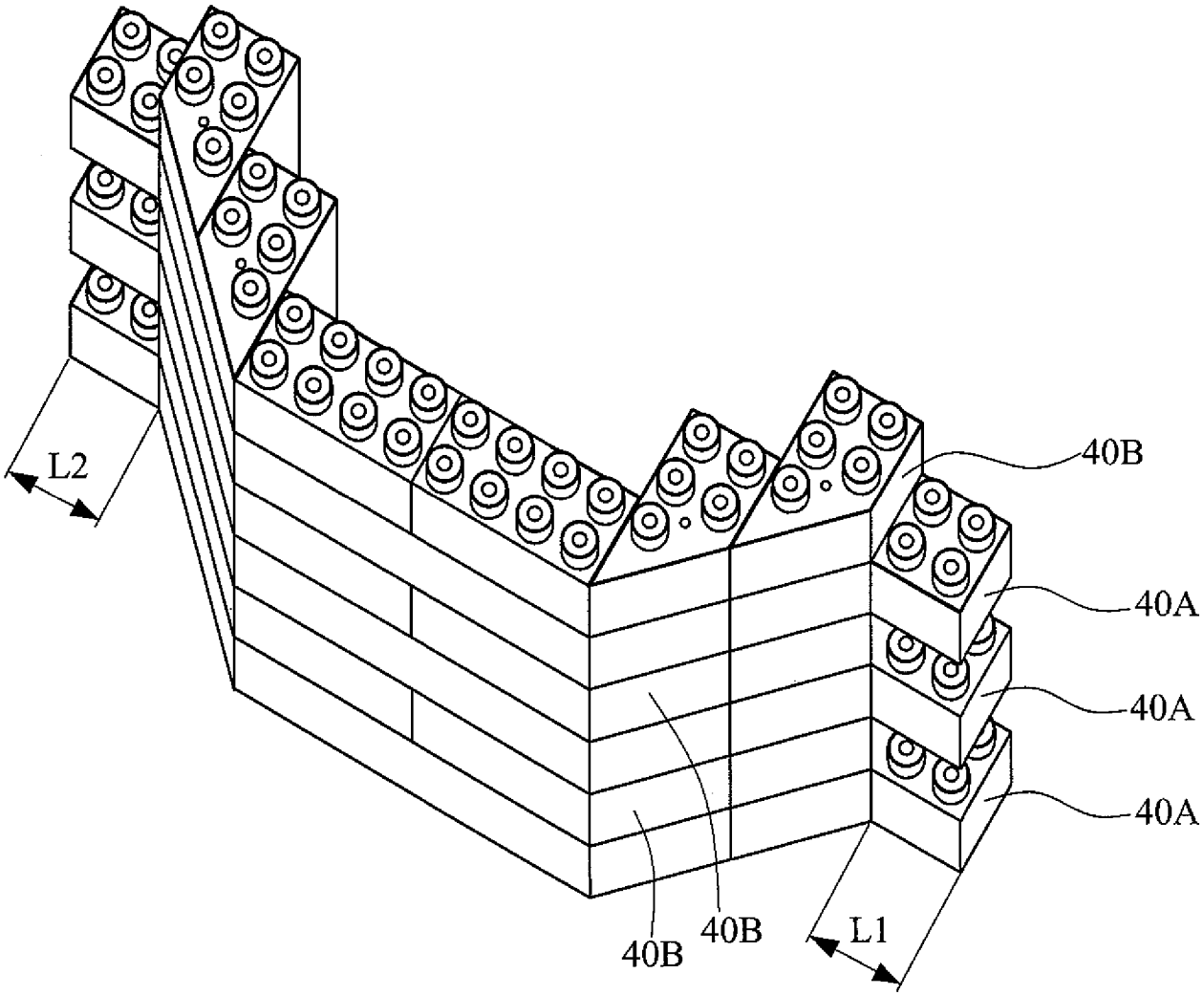
FIG. 7C is an isometric view showing the completed, neat, interlocked, V-shape assembly structure as formed after stacking up of the odd number tier toy-block group shown in FIG. 7A, and the even number tier toy-block group shown in FIG. 7B, one on top of the other in an alternating manner, while leaving a plurality of latches L1 and L2 at both ends of the assembly for further connecting to the neighboring blocks.

FIG. 7C is an isometric view showing a bay window formed after stacking up of the odd number tier blocks per layout 40A of FIG. 7A, and of the even number tier blocks per layout 40B of FIG. 7B, one on top of the other, in an alternating manner (that is, one even number tier toy group in layout 40B is stacked up on top of the odd number tier group in layout 40A, and so on alternatingly), such that all blocks in one tier group are securely interlocked with those of the other tier group (based on tier-to-tier), making a structurally sound, smoothly lined bay window assembly, while at the same time, leaving a plurality of latches L1 and L2 at the two sides of the assembly for further interlocking with its mating toy blocks at the neighboring wall, to continue towards the final completion of a building which contains the bay window.

Figure 8A:
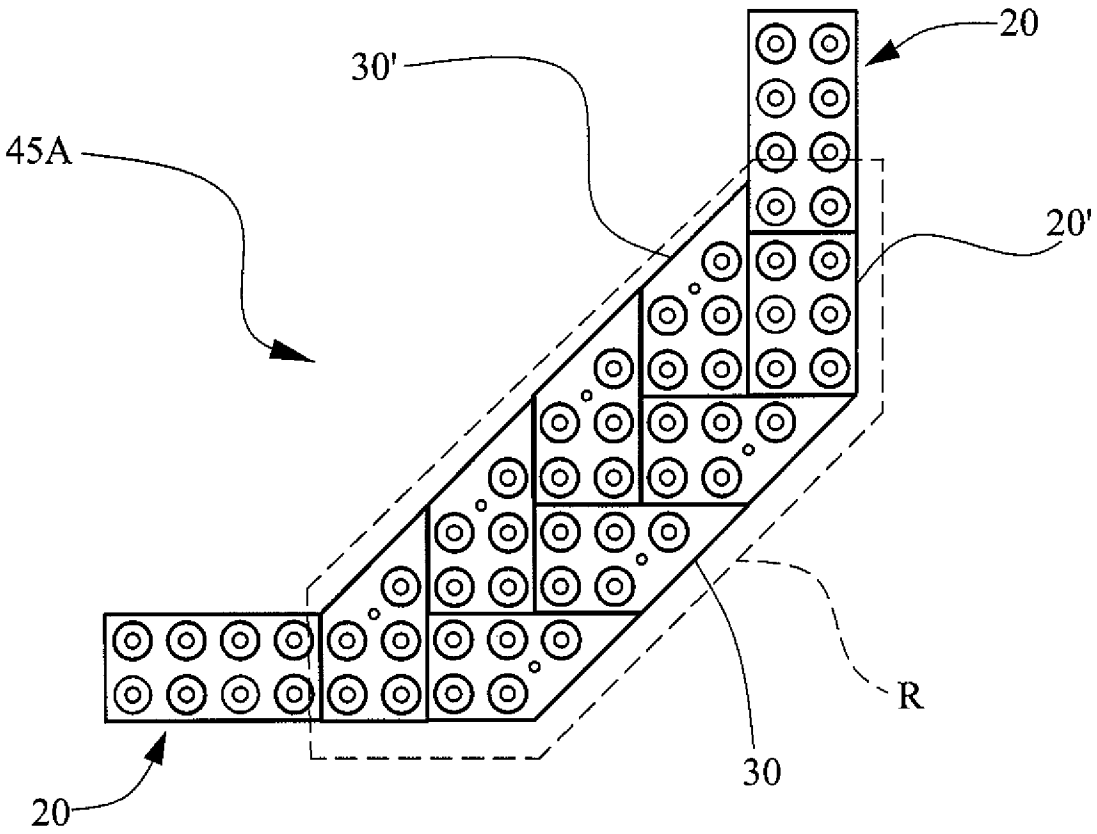
FIG. 8A is a schematic top view showing the first layout 45A for the odd number tier group of toy blocks for forming a representative corner R of an octagonal walled structure.

FIG. 8A is a schematic top view showing the first layout 45A for the odd number tier toy block group as being one of the tiers making up an oblique cornered wall R as part of a polygon structure when viewed from top. It uses a combination of the pair of wedged toy blocks (30 of FIG. 3A, and 30' of FIG. 5A), and the basic type blocks 20 of FIG. 4A, plus another "Six-Stud" type block (20') of similar construction to that of the eight-Stud type basic type block 20, except shorter in length.

Figure 8B:
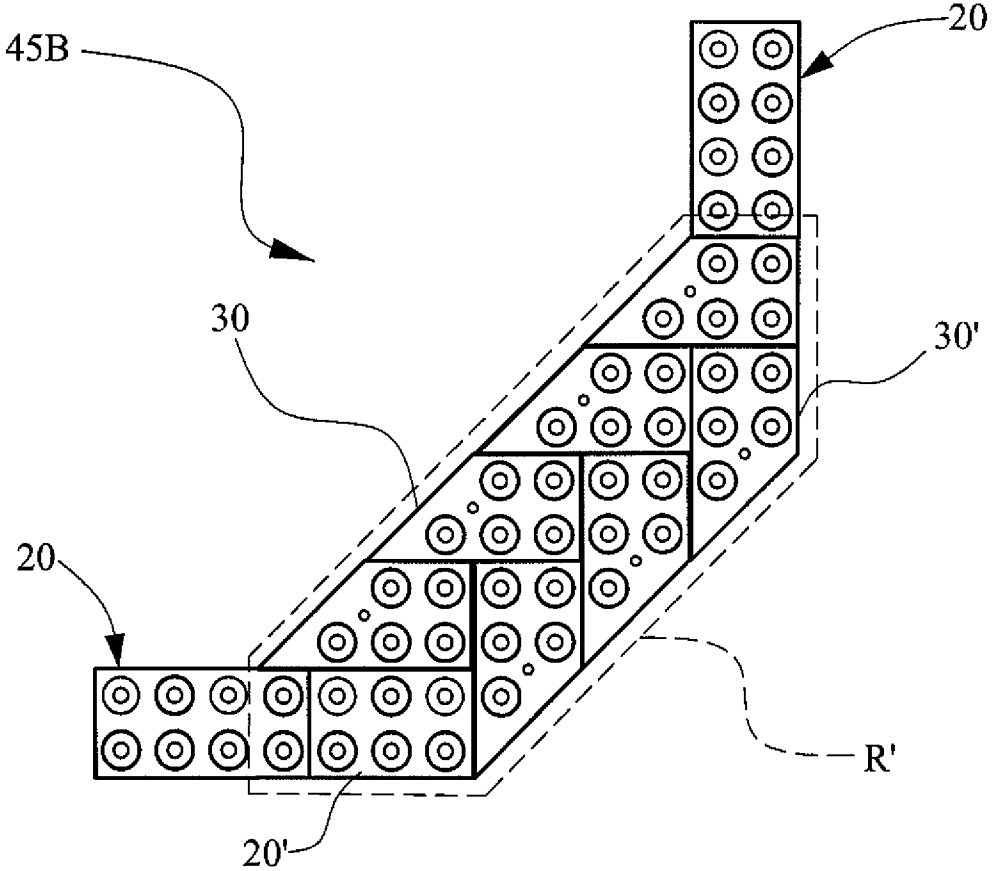
FIG. 8B is a schematic top view showing the alternating, second layout 45B for the even number tier group of toy blocks.

FIG. 8B is a schematic top view showing the alternating, second layout 45B for the even number tier toy block group, using the same combination of blocks per FIG. 8A, as being another tier making up the said oblique cornered wall R' viewed from top.

Figure 8C:
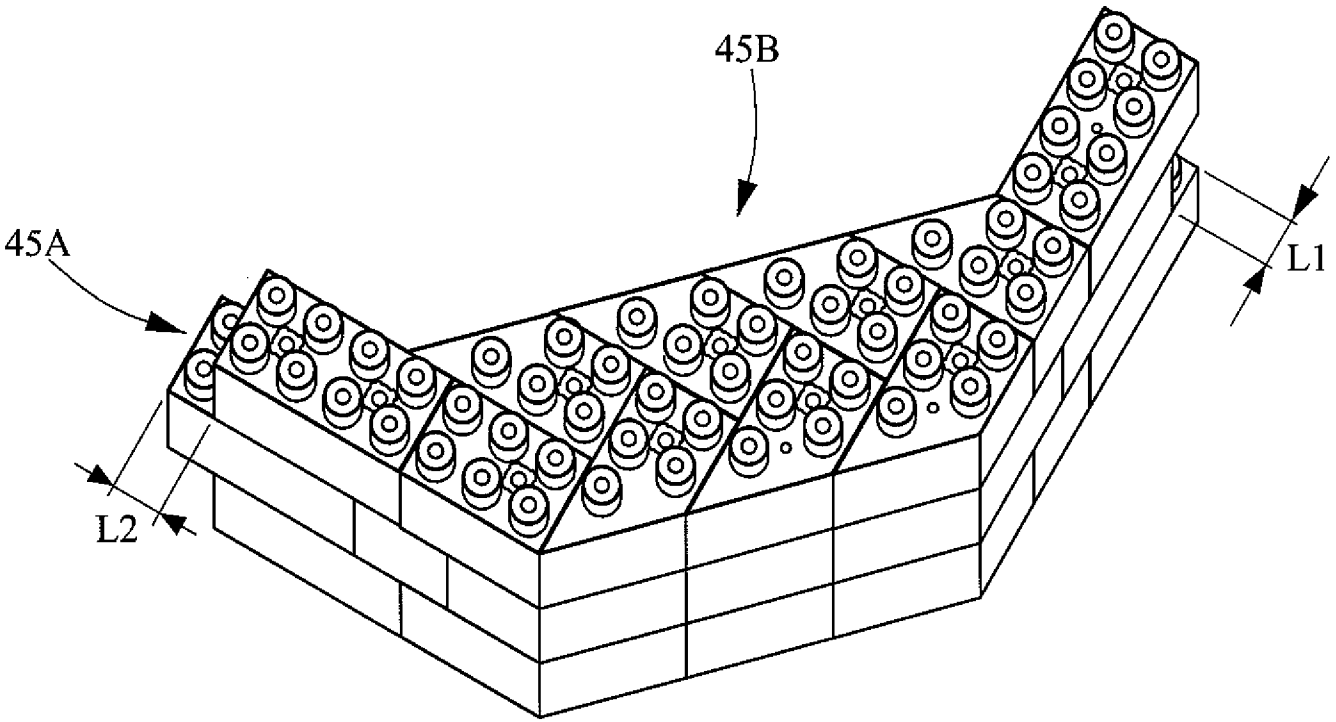
FIG. 8C is a schematic perspective view showing a polygon structure combining of the first layout 45A for the odd number tier group and the second layout 45B for the even number tier group.

Referring to FIG. 8C, similar to the above embodiments, after stacking up the tiers of toy block groups alternatingly inbetween the odd number and even number tiers, all blocks on one tier will be interlocked with the those of the other tier (based on tier-to-tier), making a structurally sound, smoothly lined oblique corner wall, while at the same time leaving a plurality of latches L1 and L2 at the sides for further interlocking with its mating toy blocks at the neighboring wall, to continue towards the final completion of a building which contains the cornered wall.

Figure 9A:
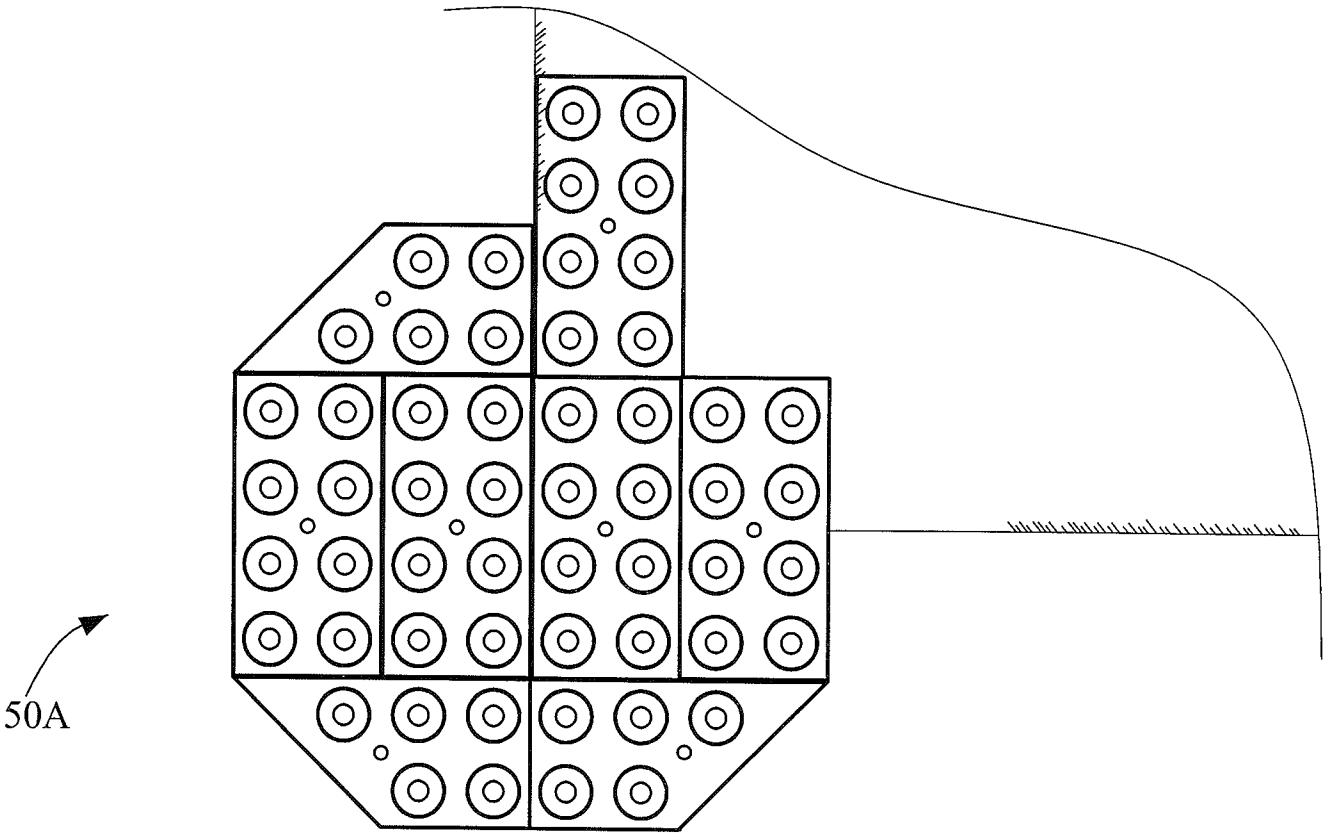
FIG. 9A is a schematic top view showing the first layout 50A for the odd number tier group of toy blocks for stacking up to a corner bay window, by using a combination of the pair of wedged toy blocks and the basic type blocks.
Figure 9B:
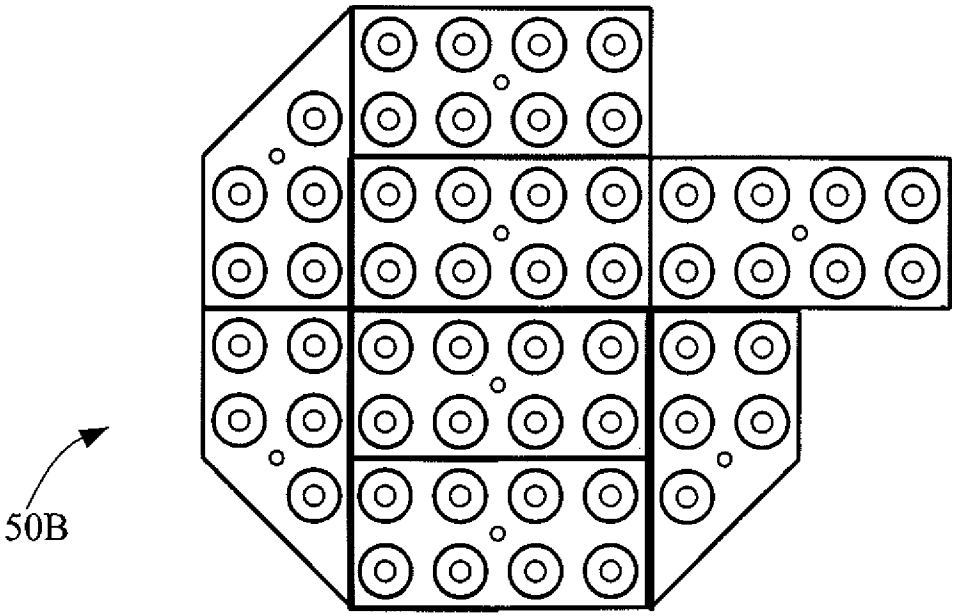
FIG. 9B is a schematic top view showing the alternating, second layout 50B for the odd number tier group of toy blocks, to enable interlocking of the two groups (the old number and the even number) of tiers when stacked one on top of the other alternatingly.

Referring to FIG. 9A and FIG. 9B, similar to those mentioned in the bay window example per FIG. 7A through 7C, FIGS. 9A and 9B represents the first layout 50A and the second layout 50B for the odd number and the even number tier toy block groups respectively, intended for constructing a simulated corner bay window.

Figure 9C:
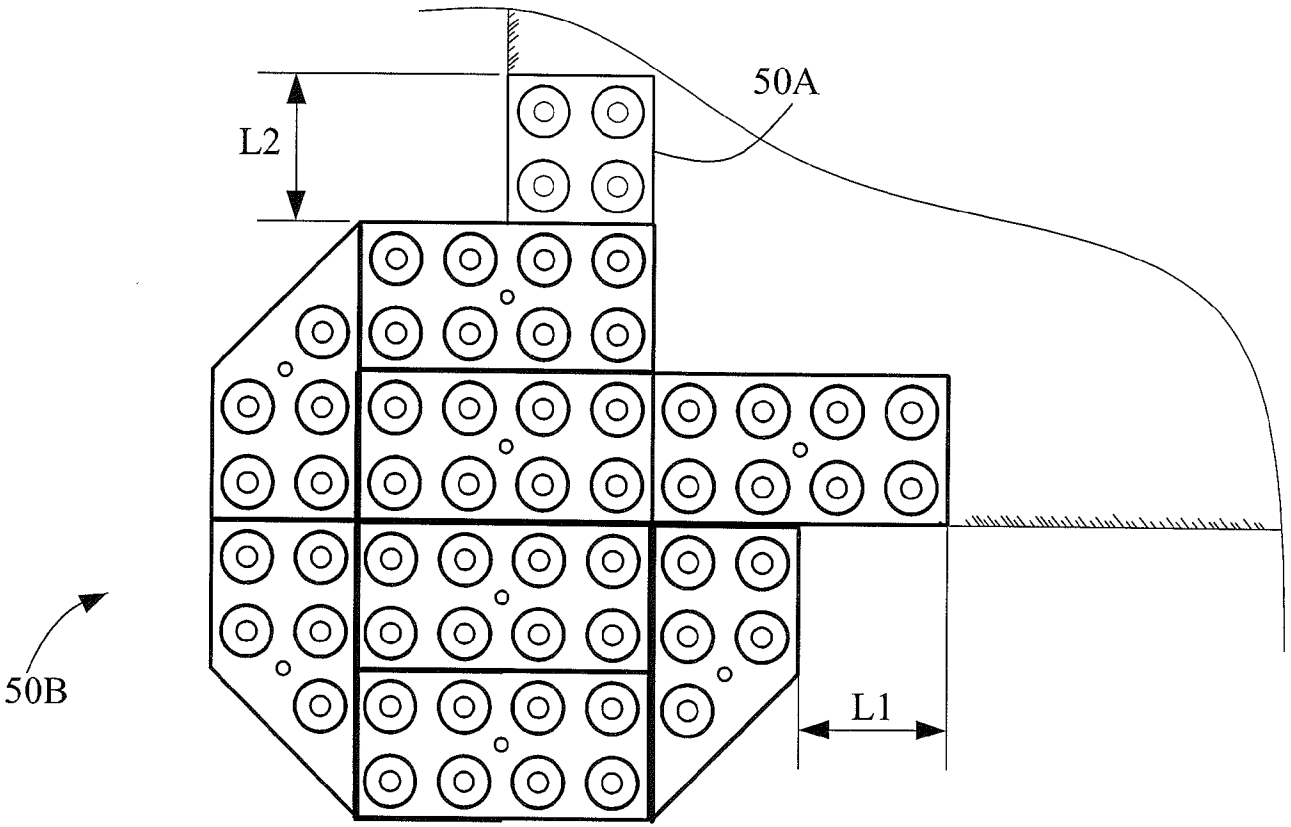
FIG. 9C is a schematic top view showing a corner bay window assembly in process, after an even number tier group of FIG. 9B is stacked on top of the odd number tier toy-block group of FIG. 9A, while leaving a number of latches L1 and L2 for further connecting to the neighboring blocks.

Referring to FIG. 9C, similar to the above working principle, after stacking up the tiers of toy block groups alternatingly inbetween the odd number and the even number tiers, most of the blocks (except for one piece length of a basic type block) on one tier will be interlocked with the those of the other tiers (tier-to-tier), making a structurally sound, smoothly lined corner bay window, while at the same time, leaving a plurality of latches L1 and L2 at the sides for further interlocking with the mating toy blocks at the intended neighboring wall, to continue towards the final completion of a building which contains the corner bay window.

Figure 9D:
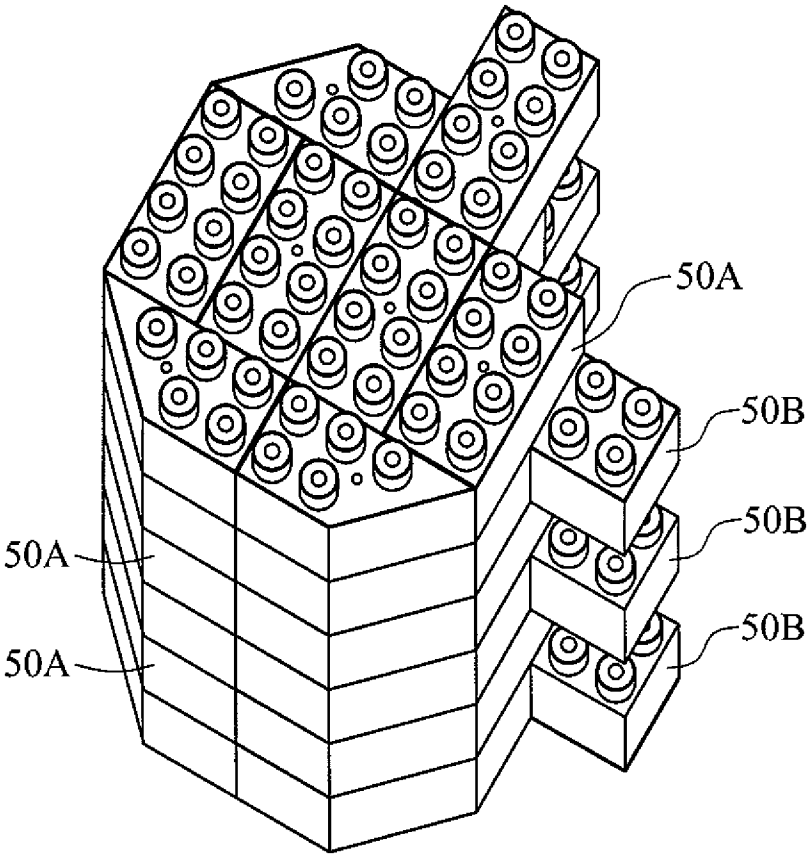
FIG. 9D is an isometric view showing the completed corner bay window assembly after stacking the tiers on top of each other, with the odd number tier toy-block group shown in FIG. 9A, and the even number tier toy-block group shown in FIG. 9B, in an alternating manner.

FIG. 9D is the isometric view of FIG. 9C showing smooth lined sidewalls on the corner bay window. One minor shortcoming with this assembling approach though, is that there is a small interior region of about one length of the basic type block 20 without interlocking, making that small region a weak spot.

Figure 10:
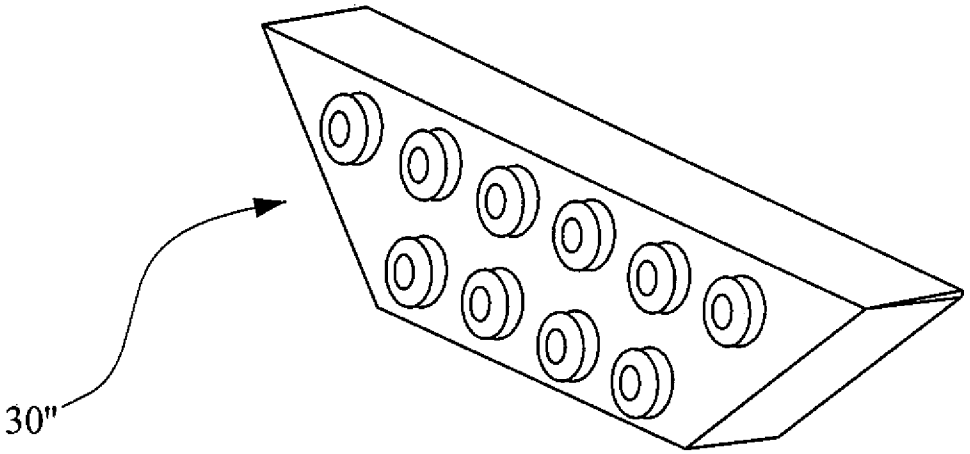
FIG. 10 is a schematic view showing a toy wedged block 30" as a variation embodiment of the present invention, by combining the two separate wedged toy blocks, into one integrated block, with wedging at both ends.

FIG. 10 is an isometric view showing a combined wedged toy block 30", as a variation embodiment of the present invention, by combining the pairs of wedged toy blocks 30 of FIG. 3A and 30' of FIG. 3B into one integral piece.

Figure 11A:
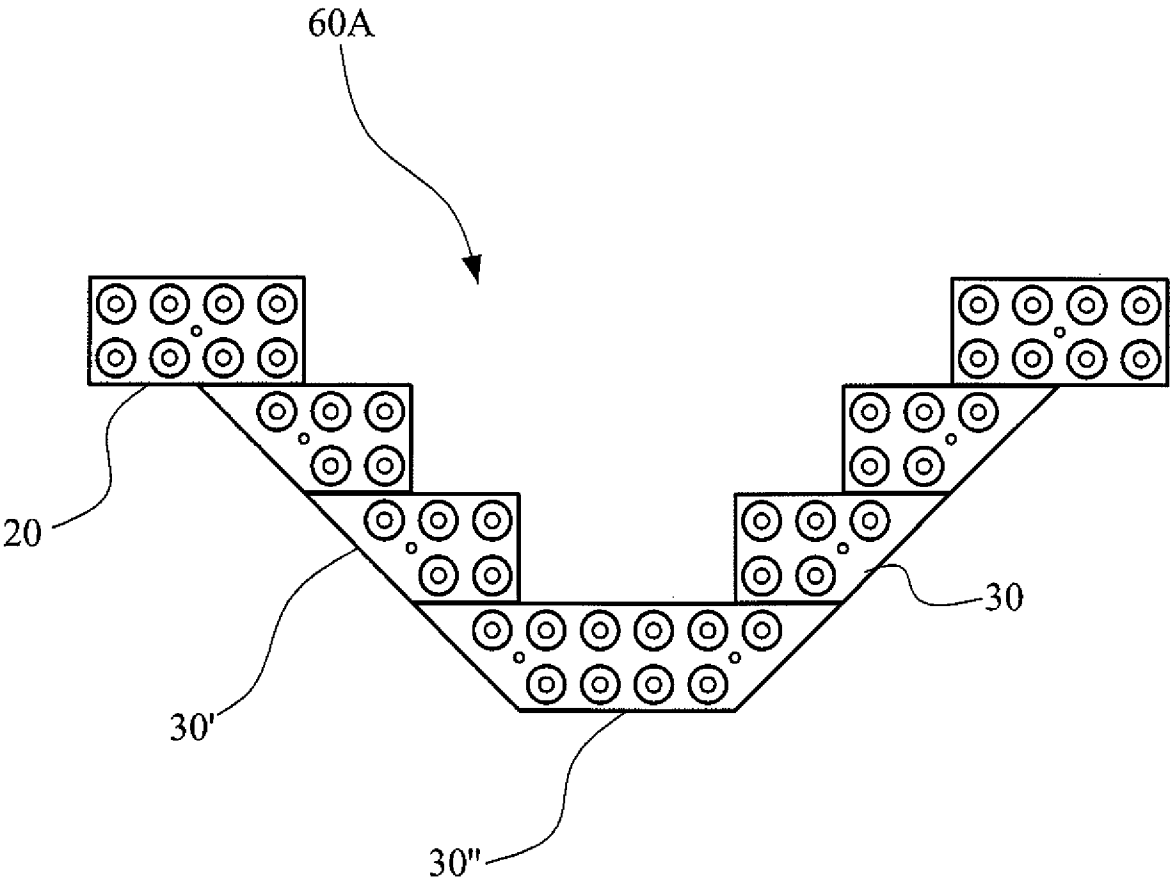
FIG. 11A is a schematic top view showing the first layout 60A for the odd number tier of block groups in stacking up to a more outward bay window (as compared to that of FIG. 7C), by using the wedged toy block of FIG. 10, in combination with the basic type blocks.

FIG. 11A is a schematic top view showing the first layout 60A for the odd number tier groups, using a combination of the combined wedged toy block 30" and the basic type block 20 of FIG. 4A, as part of a more outward bay window (compared to that of the layout 40A in FIG. 7A).

Figure 11B:
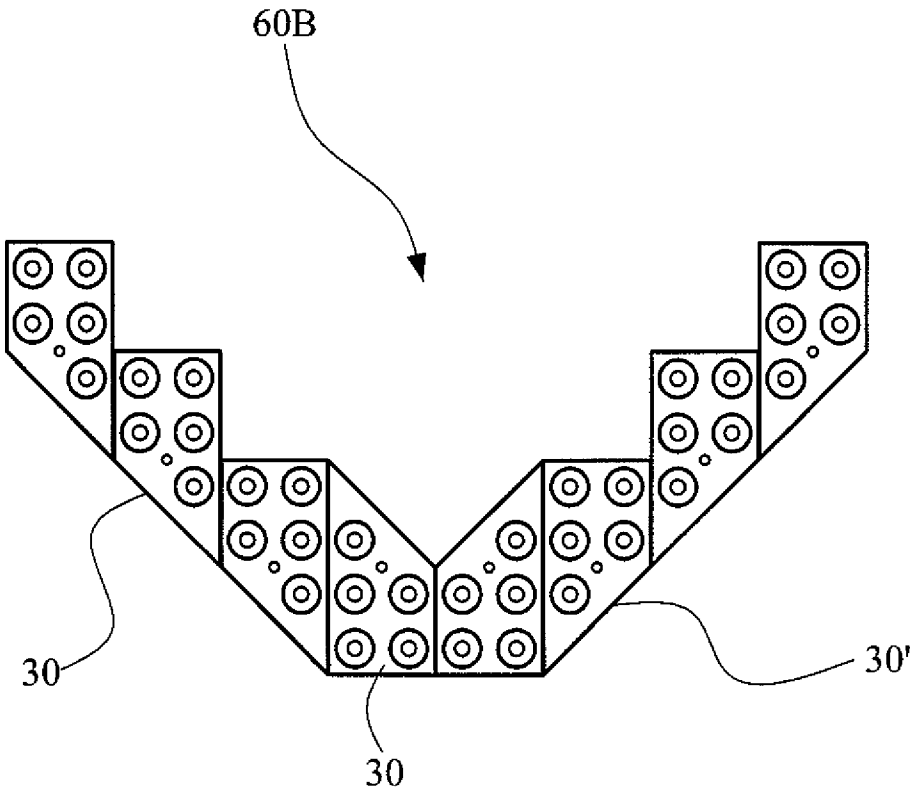
FIG. 11B is a schematic top view showing the alternating, second layout 60B for the odd number tier group of toy blocks.

FIG. 11B is a schematic top view showing the alternating, second layout 60B for the even number tier groups, also using a combination of the combined wedged toy block 30" and the basic type block 20 of FIG. 4A, as part of a more outward bay window (compared to that of the layout 40A in FIG. 7A).

Figure 11C:
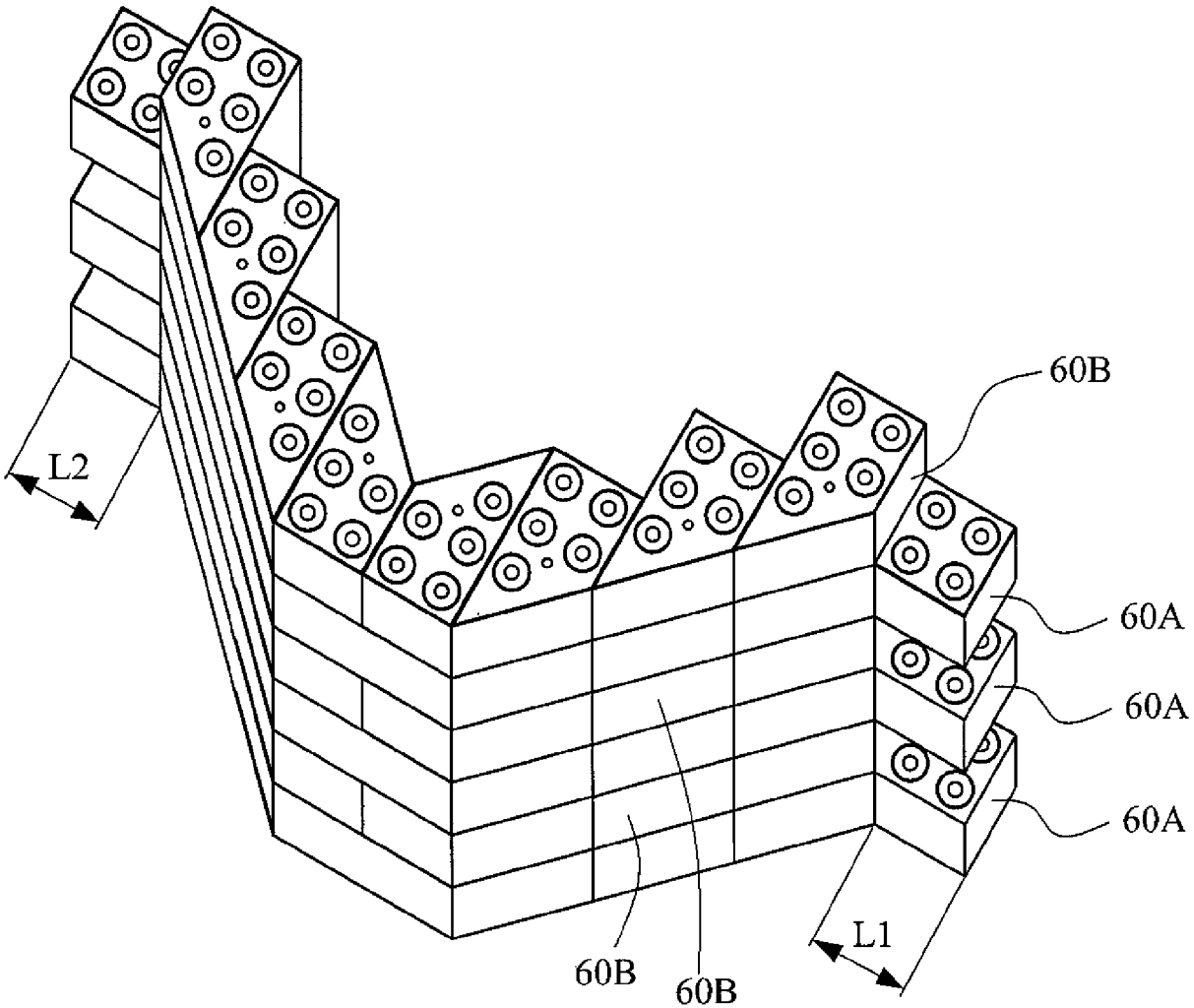
FIG. 11C is an isometric view showing the completed bay window as formed after stacking the tiers one on top of other, with the odd number tier toy-block group shown in FIG. 11A, and the even number tier toy-block group shown in FIG. 11B, in a alternating manner, while leaving a plurality of latches L1 and L2 for further connecting to the neighboring blocks.

Similar with the working principles of above embodiments of FIG. 7C and FIG. 9D, FIG. 11C is an isometric view showing the assembled bay window after stacking up the odd number tier groups of the layout 60A and the even number tier groups of the layout 60B one on top of the other alternatingly, resulting in a structurally sound, smoothly lined bay window, while at the same time leaving a plurality of latches L1 and L2 at the ends for further interlocking with the mating toy blocks of the neighboring wall to continue towards the final completion of a building containing the bay window.

Figure 12A:
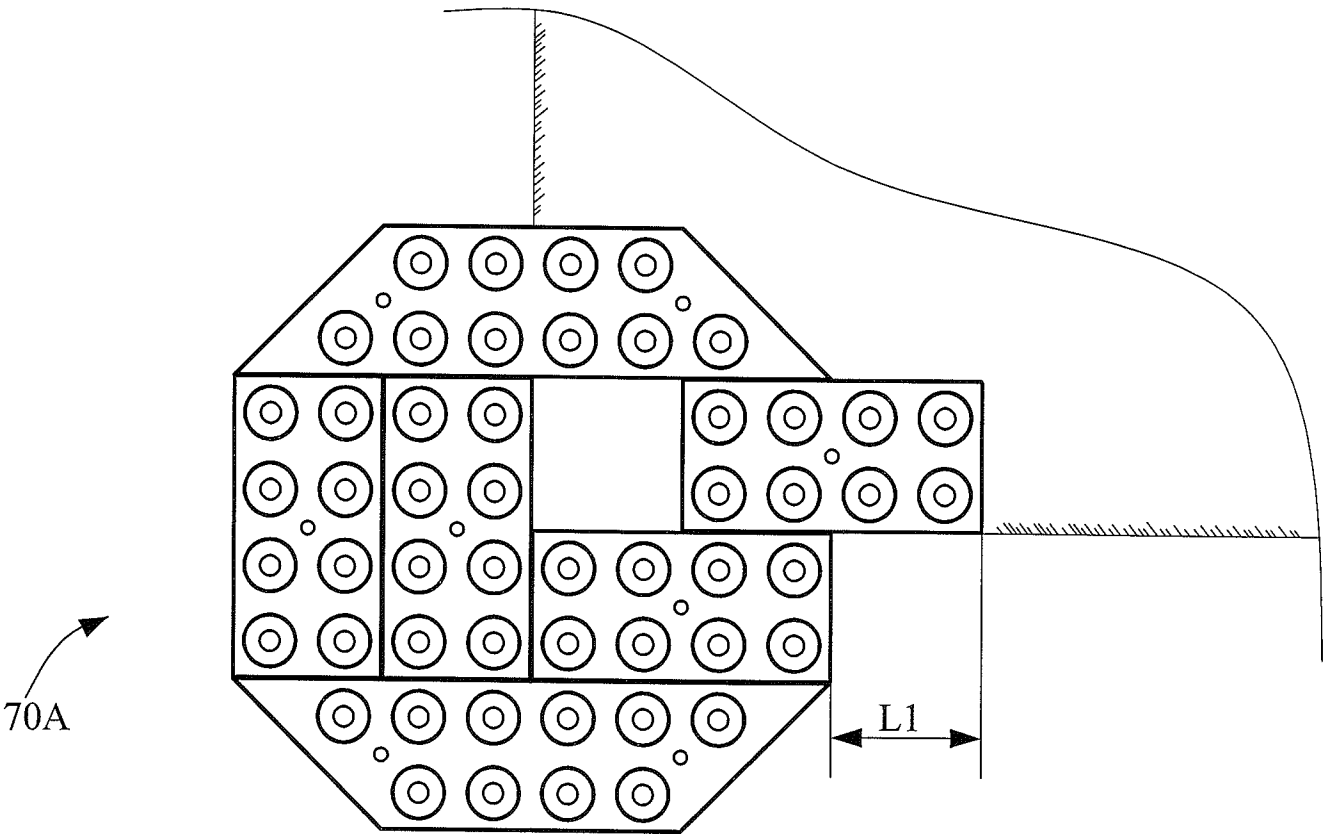
FIG. 12A is a schematic top view showing the first layout 70A for the odd number tier group of toy blocks for forming a corner bay window, by using a combination of the wedged toy block 30 of FIG. 10, and the basic type blocks of FIG. 4A.

Similar to the corner bay window layout of FIG. 9A, FIG. 12A is schematic top view showing the first layout 70A for the odd number tier groups, using a combination of the combined wedged toy block 30" in FIG. 10 and the basic type block 20 of FIG. 4A.

Figure 12B:
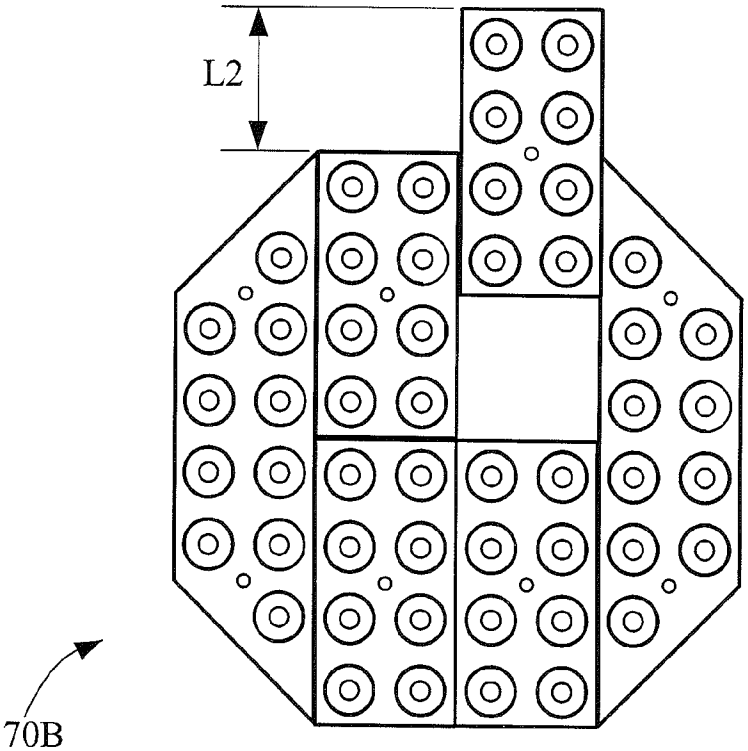
FIG. 12B is a schematic top view showing the alternating, second layout for the odd number tier group of toy blocks.

FIG. 12B is a schematic top view showing the alternating, second layout 70B for the even number tier groups, also using a combination of the combined wedged toy block 30" in FIG. 10 and the basic type block 20 of FIG. 4A.

Figure 12C:
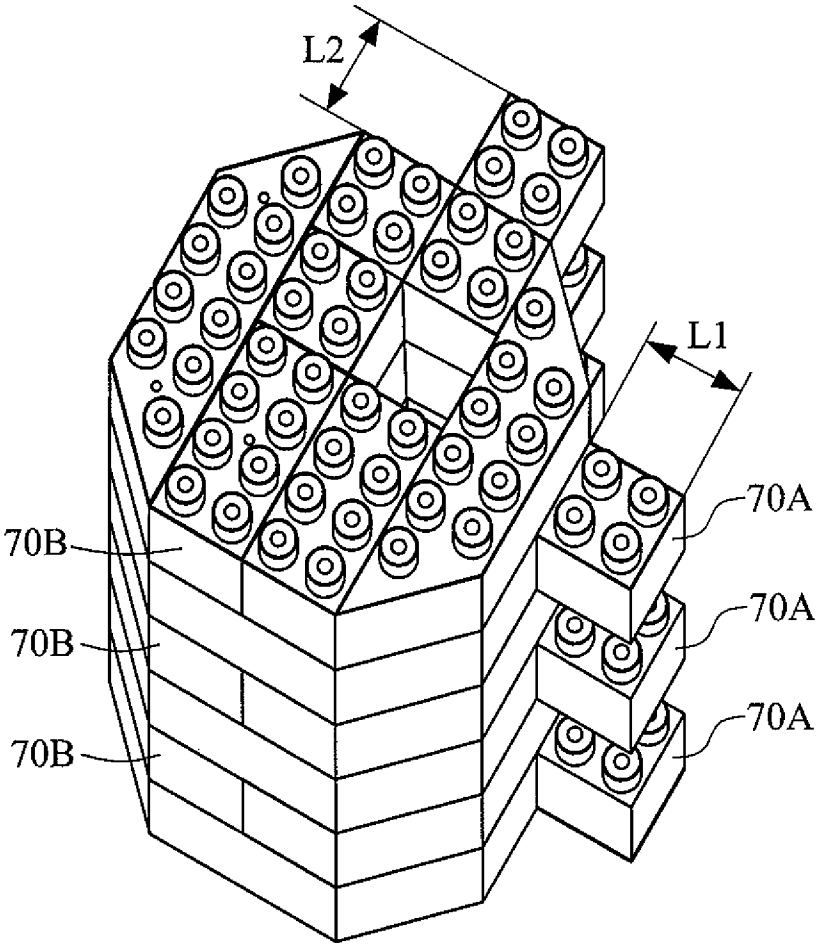
FIG. 12C is an isometric view showing the completed corner bay window assembly after stacking over one on top of the other with the odd number tier toy-block group shown in FIG. 12A, and the even number tier toy-block group shown in FIG. 12B, in an alternating manner, while leaving a plurality of latches L1 and L2 for further connecting to the neighboring blocks.

FIG. 12C is an isometric view showing the completed corner bay window assembly after stacking one on top of the other with the odd number tier toy-block group shown in FIG. 12A, and the even number tier toy-block group shown in FIG. 12B, in an alternating manner. In FIGS. 12A and 12B, a latch L1 is formed as shown in FIG. 12A, and a latch L2 is formed as shown in FIG. 12B. Similar with the working principle of above embodiments of a corner bay window in FIG. 9D, FIG. 11C is an isometric view showing the assembled bay window after stacking up the odd number tier groups 60A, and the even number tier groups one on top of the other alternatingly, resulting in a structurally sound, smoothly lined corner bay window, while at the same time leaving a plurality of latches L1 and L2 at the ends for further interlocking with the mating toy blocks of the neighboring wall, to continue towards the final completion of a building, without any weak areas this time around, because all blocks of one tier group are interlocked with that on the other tier (tier-to-tier).

Worth mentioning is that the odd number tier layout 70A shown in FIG. 12A is similar to the odd number tier layout 50A shown in FIG. 9A. The even number layout 70B shown in FIG. 12B is similar to the even number layout 50B shown in FIG. 9B. The main difference between FIGS. 9A-9B and FIGS. 12A-12B is that the layout groups shown in FIG. 12A and FIG. 12B do not use the right-hand wedged toy block 30 and the left-hand wedged toy block 30', but uses the combined wedged toy block 30" instead. That is, the right-hand wedged toy block 30 and the left-hand wedged toy block 30' can be replaced by the combined wedged toy block 30"

Figure 13A:
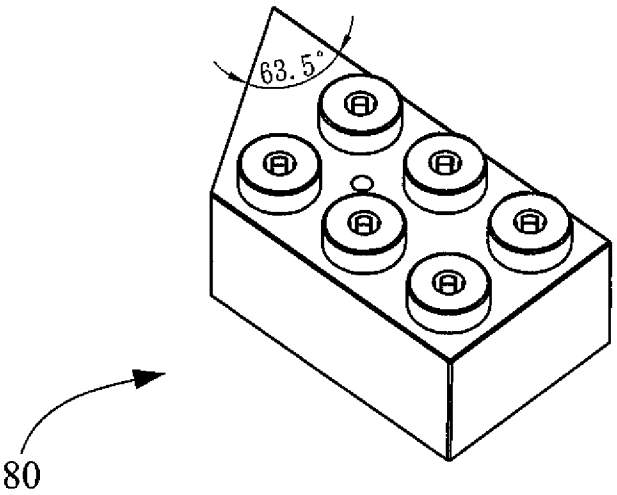
FIG. 13A is an isometric view showing a representative wedged toy block 80 with its angle $\alpha$ being at 63.5° (hereby called a 60° type wedged toy block), as one variation of the present invention

FIG. 13A is another variation embodiment of this invention, with a representative wedged toy block 80 having 63.5° at the angle α. This is formed by cutting off a corner of a basic type block (20 of FIG. 4A) by only one stud pitch.

Figure 13B:
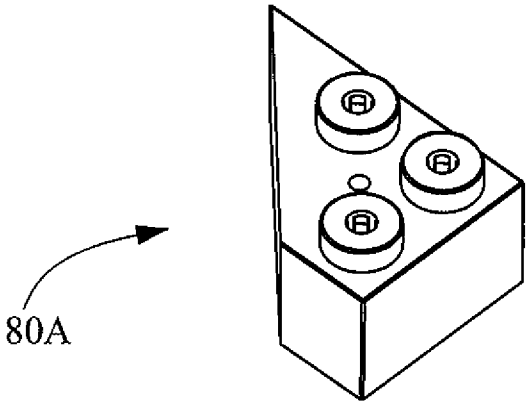
FIG. 13B is an isometric view showing another representative wedged toy block 80A, which is a shorten version of the pair of wedged toy blocks (30 of FIG. 3A, and 30' of FIG. 5A).

FIG. 13B is yet another variation embodiment of this invention, with a representative wedged toy block 80A, as a shortened size block having 45° at the angle α.

Referring to FIGS. 13A-13B, the wedged toy block 80 is similar to the wedged toy block 30. The differences between the wedged toy block 30 and the wedged toy block 80 are that the wedged toy block 80 has a smaller cut or oriel (by only one Stud-Pitch stud pitch at the corner of a basic type block 20 of FIG. 4A), than that of the wedged toy block 30 (by a cut of two stud pitches), therefore having more studs on its top surface (six studs) compared to five studs with wedged toy block 30. The sharp angle α in the wedged toy block 80 becomes (90°−tangent ½), or about 63.5°. As variation embodiments of the present invention, more selection of layouts for the tier group blocks can be chosen for stacking, by using a combination of the wedged toy block 80 and the basic type block.

As yet other embodiment, the toy block also can be per shown in FIG. 13B, the wedged toy block 80A shown in FIG. 13B as a representative, having three studs on its top surface, which is a shortened version of the pair of wedged toy blocks (30 and 30'). This is so intended as to enable smaller sized layouts for the tiers of block groups with a smaller (or miniaturized) resulting assembly.

Figure 13C:
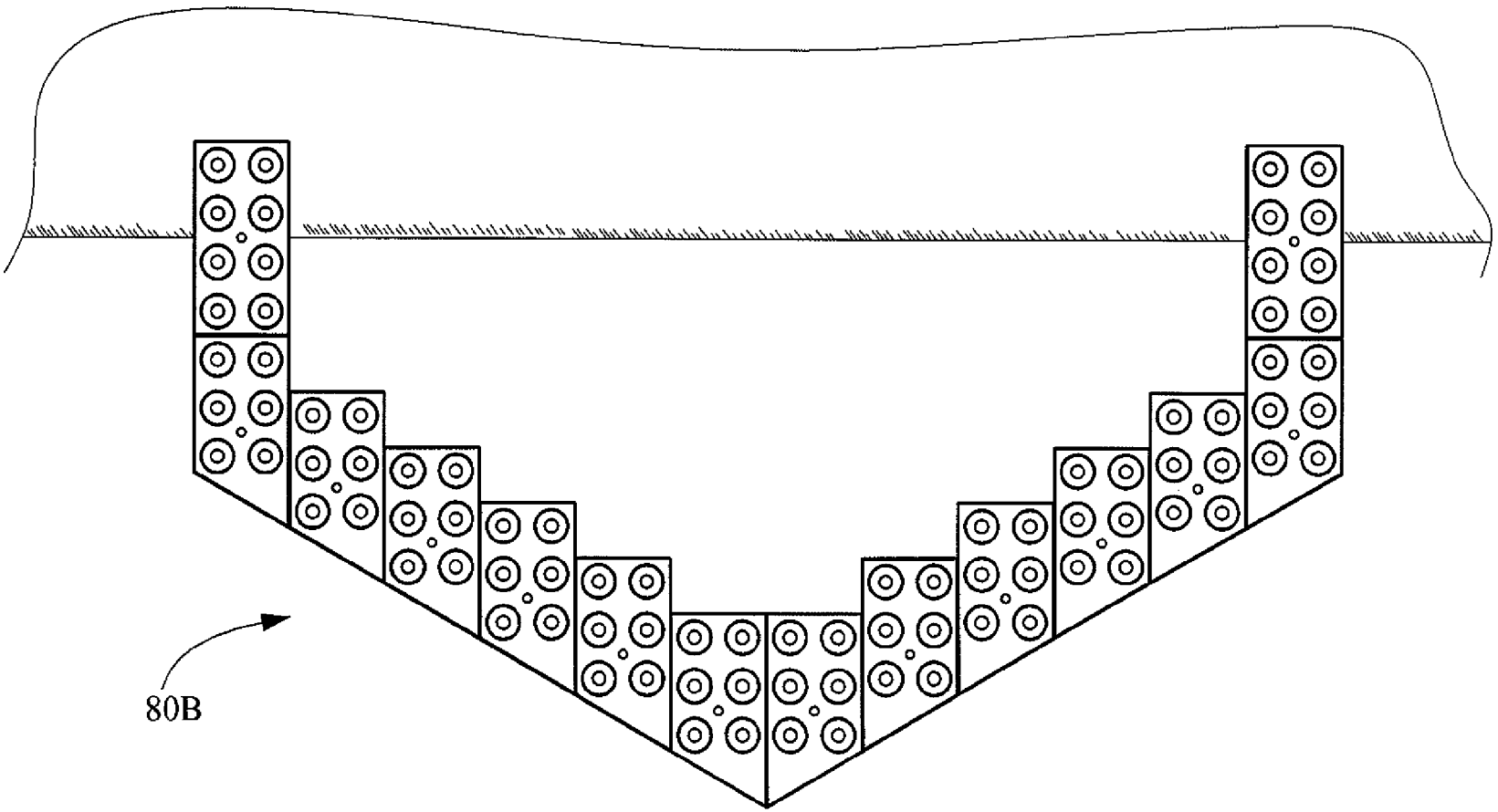
FIG. 13C is a representative layout 80B of one tier group blocks for stacking up to an oriel (or bow) bay window, by using a combination of the 60° type wedged toy block of FIG. 13A and the basic type blocks.

FIG. 13C is a representative layout 80B of one tier group block for stacking up to a oriel (or bow) bay window, by using a combination of the 60° type wedged toy block 80A of FIG. 13A and the basic type blocks.

Figure 14:
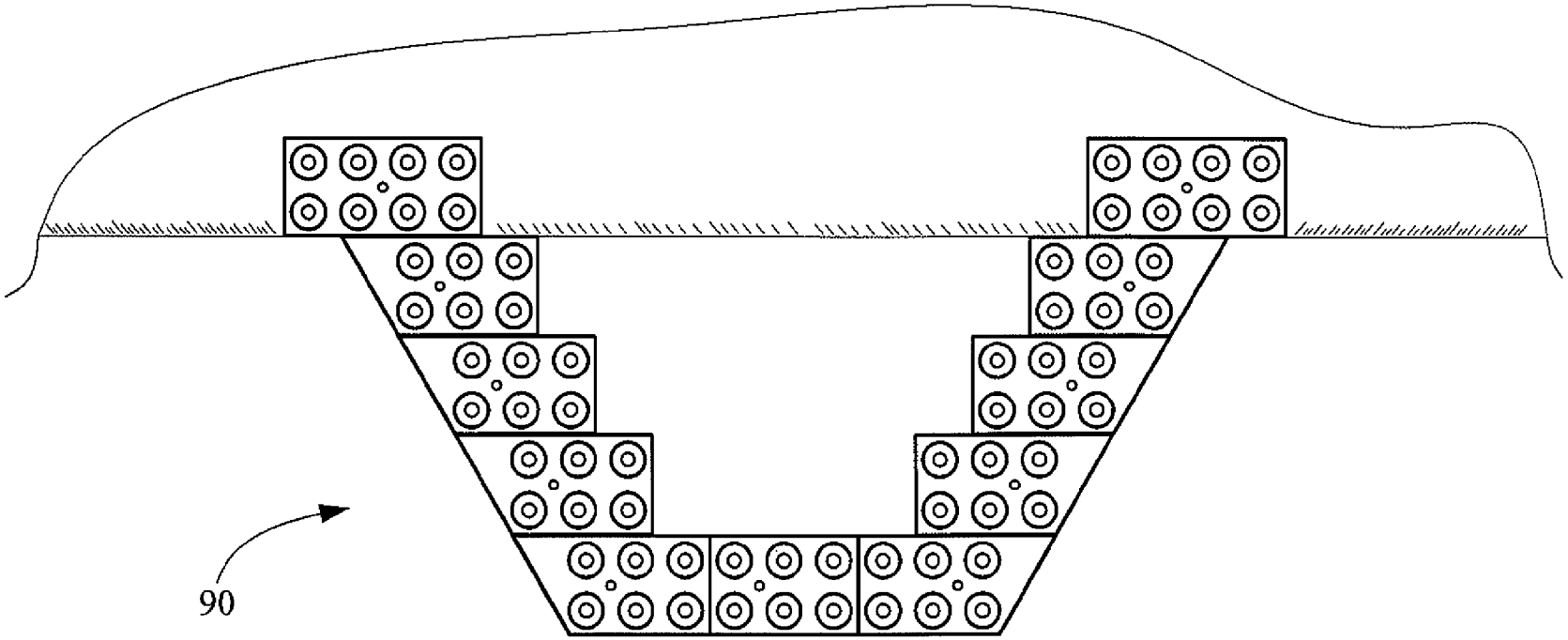
FIG. 14 is another representative layout 90 of one tier group blocks, for stacking up to a more forward canted bay window, by using a combination of the 60° type wedged toy block of FIG. 13A and the basic type blocks.

FIG. 14 is another representative layout 90 of a different tier group block, for stacking up to a more forward canted bay window, by using a combination of the 60° type wedged toy block 80A of FIG. 13A and the basic type blocks To sum up, in the toy-block set, namely the pair of wedged toy blocks 30 and 30', and the combined wedged toy block 30" of the invention, in combination with the more commonly seen types of blocks similar to the rectangular eight-stud type basic type block 20, or the rectangular six-stud type block 20', can achieve neat, smooth sides (or planes) on cases such as a polygon cornered wall or a bay window, by stacking up the odd number tier of block groups with the even number tier of block groups one on top of the other in an alternating manner. All blocks in one tier will interlock with those of the other tier on a tier-to-tier basis, resulting in a structurally sound and smoothly lined assembly, while at the same time, leaving a plurality of latches (L1 and L2) at the both ends of the assembly for further interlocking with the mating toy blocks of the neighboring blocks to continue towards the final completion of a building.

Although the invention has been described with reference to the above embodiments, it will be apparent to one of the ordinary skill in the art that variations to the described embodiments may be made without departing from the spirit of the invention. Accordingly, the scope of the invention will be defined by the attached claims rather than by the above detailed descriptions.

What is claimed is:

1. A pairing block set made of plastic material, comprising:

a left-hand wedged toy block; and a right-hand wedged toy block;

wherein the left-hand wedged toy block and the right-hand wedged toy block each has:

a top side having a right angled trapezoid contour, wherein the trapezoid contour on the left hand wedge block is in mutual mirror symmetry to the trapezoid contour on the right hand wedge block;

a bottom side having a same trapezoid contour as the top side respectively;

four sidewalls, all having a same height and all perpendicularly connected between the top side and the bottom side, with each sidewall shaped in a respective rectangle contour; wherein the four sidewalls include an oblique sidewall with one end connected to a neighboring sidewall at a sharp angle of 45 degrees;

a plurality of studs at the top side among which only one stud is disposed on a right angled triangular area at the top side wherein the oblique sidewall constitutes a hypotenuse of the right angled triangular area, a plurality of recessed portions at the bottom side, and a plurality of bottom posts at the bottom side, respectively;

wherein the four sidewalls are all plane surfaces having no stud, recessed portion and bottom post, and the plurality of bottom posts are surrounded by the plurality of recessed portions, so that when one of the plurality of studs is inserted into one of the plurality of recessed portions of another toy block, the said one of the plurality of studs abuts against a corresponding bottom posts of the said another toy block, and said one of the plurality of studs fixed to the one of the plurality of recessed portions of the said another toy block.

2. The pairing block set of claim 1, further comprising a combined wedge block having a plurality of sidewalls, wherein two of the plurality of sidewalls of the combined wedge block connect to another sidewall which neighbor to the said sidewall obliquely;

wherein the combined wedge block is a combination of the left-hand wedged toy block and the right-hand wedged block into one integral piece of an isosceles trapezoid shape.

* * * * *